US009199152B2

(12) United States Patent
Phillips

(10) Patent No.: US 9,199,152 B2
(45) Date of Patent: Dec. 1, 2015

(54) GOLF SWING TRAINER

(71) Applicant: Landon K. Phillips, San Antonio, TX (US)

(72) Inventor: Landon K. Phillips, San Antonio, TX (US)

( * ) Notice: Subject to any disclaimer, the term of this patent is extended or adjusted under 35 U.S.C. 154(b) by 0 days.

(21) Appl. No.: 14/190,254

(22) Filed: Feb. 26, 2014

(65) Prior Publication Data

US 2015/0005091 A1 Jan. 1, 2015

Related U.S. Application Data

(60) Provisional application No. 61/769,533, filed on Feb. 26, 2013.

(51) Int. Cl.
*A63B 69/36* (2006.01)
*A63B 15/00* (2006.01)

(52) U.S. Cl.
CPC ..... *A63B 69/3632* (2013.01); *A63B 15/00* (2013.01); *A63B 2209/00* (2013.01)

(58) Field of Classification Search
USPC ..... 473/219, 226, 228, 229, 256, 437, 457, 473/409
See application file for complete search history.

(56) References Cited

U.S. PATENT DOCUMENTS 3,416,803 A * 12/1968 Batista ..... 473/228
4,343,473 A 8/1982 Laursen
4,511,147 A 4/1985 Olsen
5,082,283 A 1/1992 Conley et al.
5,092,601 A 3/1992 Rilling
5,203,569 A 4/1993 Rilling
5,207,625 A * 5/1993 White ..... 482/111
5,394,914 A * 3/1995 Meek ..... 150/160
5,474,299 A 12/1995 Romano
5,499,820 A 3/1996 Albertsson
5,582,407 A 12/1996 Sorenson
5,628,695 A 5/1997 Worthington et al.
5,634,854 A 6/1997 Albertsson
5,672,118 A 9/1997 Robbie
5,743,805 A 4/1998 Richter
5,779,567 A 7/1998 Durso
5,803,838 A * 9/1998 DeMarini et al. ..... 473/437
5,860,871 A 1/1999 Marley, Jr.
5,860,873 A 1/1999 Karasavas
5,893,805 A 4/1999 Douglass
5,916,037 A 6/1999 Hill
6,059,668 A 5/2000 Marley, Jr.
6,102,810 A * 8/2000 Boland ..... 473/256
6,120,386 A 9/2000 Hill
6,358,157 B1 3/2002 Sorenson
6,379,261 B1 4/2002 Hart
6,390,930 B1 5/2002 Gauer
6,463,971 B1 * 10/2002 Kinsey ..... 150/160

(Continued)

*Primary Examiner* — Nini Legesse
(74) *Attorney, Agent, or Firm* — Osha Liang LLP

(57) ABSTRACT

A golf swing trainer (GST) device, for use on a golf club of the type having a shaft and a club head connected at a neck of the shaft is provided. The GST device includes a cape and a fastener for securing the cape to the golf club. The cape includes a flexible fabric material formed with an exterior edge defining a substantially symmetrical shape, a first opening, and a second opening generally centrally located in the symmetrical flexible fabric material, the first and second openings sized for receiving the golf club therethrough, and defining a connection region of flexible material between the first and second openings. The fastener secures the cape to the golf club with the club shaft extended through the first and second openings with the connection region overlaying the neck of the club adjacent to the club head.

23 Claims, 12 Drawing Sheets

(56) References Cited

U.S. PATENT DOCUMENTS

| | | | | |
|---|---|---|---|---|
| 6,464,597 | B1 | 10/2002 | Hardesty | |
| 6,485,374 | B1 | 11/2002 | Myerscough | |
| 6,800,036 | B2 | 10/2004 | Rohan-Weaver | |
| 6,866,592 | B1 | 3/2005 | Gitre | |
| 6,881,155 | B2 | 4/2005 | Rohan-Weaver | |
| 7,029,401 | B1 | 4/2006 | Sowerwine | |
| 7,090,589 | B2 | 8/2006 | Andersen | |
| 7,172,515 | B2 | 2/2007 | Costa et al. | |
| 7,326,124 | B1 | 2/2008 | Fairbanks | |
| 7,364,512 | B2 | 4/2008 | Graedener | |
| 7,431,661 | B1 | 10/2008 | Cailey | |
| 7,465,242 | B2 | 12/2008 | Ward et al. | |
| 7,497,785 | B2 * | 3/2009 | Koncelik, Jr. | 473/228 |
| 7,510,480 | B2 | 3/2009 | Lesko | |
| 7,572,192 | B1 | 8/2009 | Boyd | |
| 7,753,805 | B2 * | 7/2010 | Scaperotti | 473/228 |
| 7,762,929 | B1 | 7/2010 | Celone | |
| 7,785,211 | B2 | 8/2010 | Hackenberg | |
| 7,806,780 | B1 | 10/2010 | Plunkett | |
| 8,021,242 | B1 | 9/2011 | Tennison | |
| 2003/0186758 | A1 | 10/2003 | Rohan-Weaver et al. | |
| 2003/0190971 | A1 | 10/2003 | Rohan-Weaver | |
| 2003/0190972 | A1 | 10/2003 | Townsend | |
| 2003/0191971 | A1 | 10/2003 | Klensin et al. | |
| 2004/0198526 | A1 | 10/2004 | Rohan-Weaver | |
| 2005/0209015 | A1 | 9/2005 | Costa et al. | |
| 2005/0261074 | A1 | 11/2005 | Andersen | |
| 2006/0040760 | A1 | 2/2006 | Du Preez | |
| 2006/0073903 | A1 | 4/2006 | Graedener | |
| 2006/0258476 | A1 | 11/2006 | Andersen | |
| 2006/0287122 | A1 * | 12/2006 | Ray | 473/228 |
| 2007/0087856 | A1 | 4/2007 | Rodriguez et al. | |
| 2007/0117643 | A1 | 5/2007 | Ward et al. | |
| 2007/0129159 | A1 * | 6/2007 | Koncelik, Jr. | 473/226 |
| 2007/0155523 | A1 | 7/2007 | Lesko | |
| 2008/0039223 | A1 | 2/2008 | Fairbanks | |
| 2008/0207347 | A1 | 8/2008 | Rose | |
| 2009/0082124 | A1 | 3/2009 | Hackenberg | |
| 2010/0022319 | A1 * | 1/2010 | Scaperotti | 473/228 |
| 2011/0250982 | A1 | 10/2011 | Romano | |
| 2011/0287850 | A1 | 11/2011 | Heizelman | |
| 2011/0306434 | A1 | 12/2011 | Crabtree | |

* cited by examiner

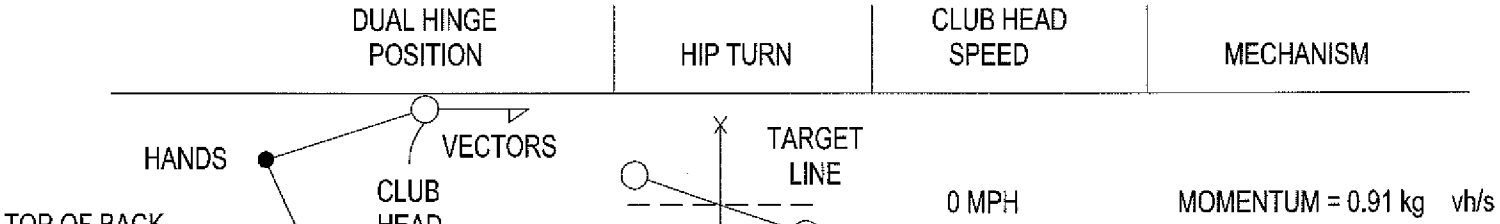
FIG. 9A
FIG. 9B
FIG. 9C
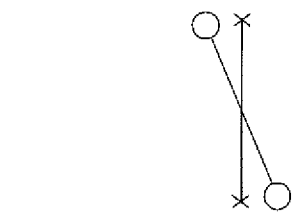
FIG. 10B
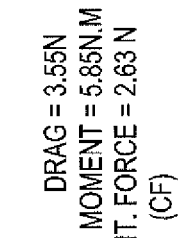
FIG. 10C
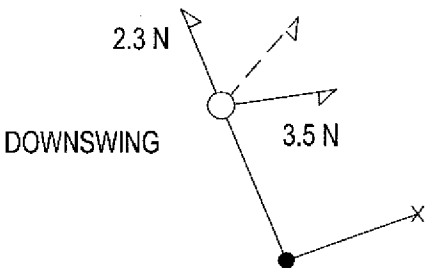
FIG. 10A

| DUAL HINGE POSITION | HIP TURN | CLUB HEAD SPEED | MECHANISM |
|---|---|---|---|
| 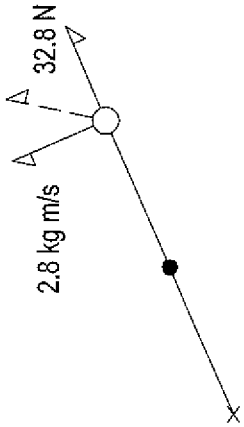  FIG. 17A | 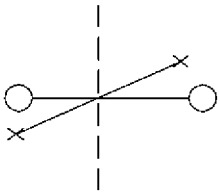 FIG. 17B | 42 MPH | CF = 32.78 N<br>= 22 G = 3.3 kg = 7.3 LBS<br>MOMENTUM = 2.8 KG = 7.3 LBS<br>(M)<br>FIG. 17C |
| 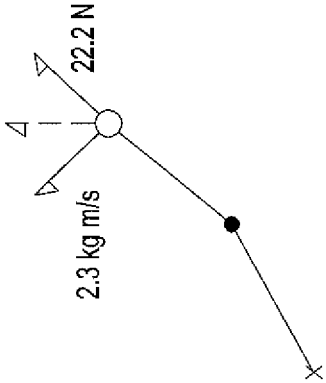  FIG. 18A | 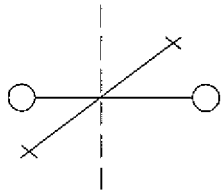 FIG. 18B | 35 MPH | CF = 22.23 N<br>= 15 G = 2.25 kg = 5 LBS<br>M = 2.34 kg m/s<br>FIG. 18C |

GOLF SWING TRAINER

CROSS-REFERENCE TO RELATED APPLICATIONS

This application claims the benefit of U.S. Provisional Application 61/769,533 filed on Feb. 26, 2013.

BACKGROUND OF INVENTION

1. Field of the Invention

This invention relates generally to devices, methods, and systems for training golfers to properly swing a golf club for good hitting of a golf ball.

2. Background Art

Playing the game of golf well depends upon the player learning to swing a golf club using proper form for accuracy and power. Many training devices, methods and systems have been developed in an effort to teach or improve proper form for swinging a golf club.

SUMMARY OF INVENTION

According to one or more embodiments, the inventor has discovered a novel device, method and system for training a person to swing a golf club properly and to improve the "form" of the swing that a person may have developed previously.

According to one or more embodiments the invention addresses common swing flaws found in the golf swing of amateur golfers. It addresses one or more common backswing errors, common downswing errors, and common follow-through errors. It uniquely addresses a plurality of these common faults while simultaneously teaching the golfer how to swing the club in the most efficient manner utilizing increased resistance. A unique flexible design allows the golf swing trainer device to move about the club shaft at advantageous times and in useful ways to provide real-time feedback to the golfer and to encourage proper swing mechanics.

According to one or more embodiments, a method is provided by which a person, such as a golfer, may use the golf swing trainer device according to steps that will facilitate learning how to make a proper golf swing and/or training to correct or to improve a previously learned golf swing. In one or more embodiments the user applies the golf swing trainer device to the head end of the golf club shaft. The user executes a plurality of complete swings with the golf swing trainer device fastened to the golf club. The user executes a smaller number of swings without the golf swing trainer. In one embodiment the plurality of swings with the trainer device are followed with the smaller number of swings. The user also hits at least one ball without the trainer. This will develop muscle memory as the golfer's body learns the proper sequence to maximize efficient power. For example, the plurality of swings might comprise 10 swings with the golf swing trainer on the club and the smaller number of swings without the golf swing trainer on the club may comprise 2 swings, and there may be one swing actually hitting a golf ball. The process may be repeated and over time the muscle memory will continue to develop as the golfer's body continues to learn and confirm the proper sequence to maximize efficient power and accuracy. Similar to any other action that becomes a habit, it takes time and repetition to permanently "fix" the swing action, so practice is required.

According to one or more embodiments of the present invention, there is provided a golf swing trainer that is lightweight, reusable, convenient to carry, easy to install onto a golf club, and easy to take off of the golf club. The structure of the golf club trainer properly installed on the club encourages and provides feedback feel to the golfer for a proper takeaway portion of a golf swing. The golf club trainer provides aerodynamic resistance perpendicular to the club shaft throughout the downswing that causes proper bio-mechanical sequencing of the golfer's body during the downswing. The golf swing trainer also encourages a proper finishing position due to increased momentum at the golf club head where the golf swing trainer is attached.

Other aspects and advantages of the invention will be apparent from the following description and the appended claims.

BRIEF DESCRIPTION OF DRAWINGS

FIGS. 9A, 9B, and 9C are schematic depictions of diagrams for the top of the backswing at a position for reversing the direction to start the downswing showing, in FIG. 9A, a theoretical position of the golfer's hips and shoulders, showing, in FIG. 9B, a dual hinge link arm model of the shoulder, arm, club, and golf swing trainer system presenting theoretical estimated vector forces imparted by the golf swing trainer according to one or more embodiments, and showing, in FIG. 9C, theoretically determined speed, drag, momentum and centrifugal force values.

FIGS. 10A, 10B, and 10C are schematic depictions of diagrams for a downswing initiation position of the downswing showing, in FIG. 10A, a theoretical position of the golfer's hips and shoulders, showing, in FIG. 10B, a dual hinge link arm model of the shoulder, arm, club, and golf swing trainer system presenting theoretical estimated vector forces imparted by the golf swing trainer according to one or more embodiments, and showing in FIG. 10C theoretically determined speed, drag, momentum and centrifugal force values.

FIGS. 17A, 17B, and 17C are schematic depictions of diagrams for a rotation position of the follow-through swing showing, in FIG. 17A, a theoretical position of the golfer's hips and shoulders, showing, in FIG. 17B, a link arm model of the shoulder, arm, club, and golf swing trainer system presenting theoretical, estimated vector forces imparted by the golf swing trainer according to one or more embodiments, and showing, in FIG. 17C, theoretically determined speed, drag, momentum and centrifugal force values.

FIGS. 18A, 18B, and 18C are schematic depictions of diagrams for an upward rotation position of the follow-through swing showing, in FIG. 18A, a theoretical position of the golfer's hips and shoulders, showing, in FIG. 18B, a link arm model of the shoulder, arm, club, and golf swing trainer system presenting theoretical, estimated vector forces imparted by the golf swing trainer according to one or more embodiments, and showing, in FIG. 18C, theoretically determined speed, drag, momentum and centrifugal force values.

DETAILED DESCRIPTION

According to one or more embodiments, the invention addresses common swing flaws found in golf swings of amateur golfers. It addresses one or more common backswing errors, common downswing errors, and common follow-through errors. It uniquely addresses a plurality of these common faults while simultaneously teaching the golfer how to swing the club in the most efficient manner utilizing increased resistance. A golf swing trainer (GST) device is disclosed having a unique flexible design that allows the GST to move about the club shaft at advantageous times and in useful ways to provide real-time feedback to the golfer and to encourage proper swing mechanics.

Figure 1:
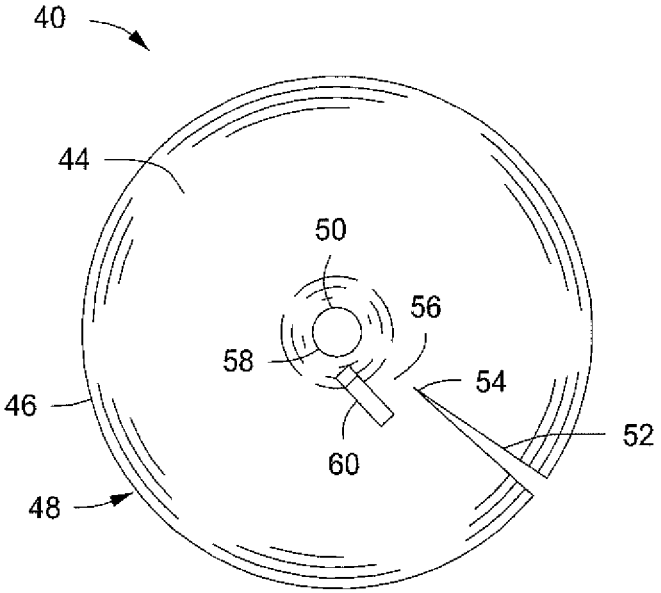
FIG. 1 is a top view of one embodiment of a golf swing trainer prior to installation on a golf club.

One embodiment of a golf swing trainer 10 (GST) is shown in FIG. 1. In this depiction the inventive GST 40 is shown from a top view and prior to installation on a golf club. It will be understood based upon this disclosure that the GST is useful and adapted to be used on a golf club 20 of the type shown in FIG. 3 having a shaft 22 with a hand grip region 24, a middle region 26, a neck 29, and a club head 30 connected at the neck 28 of the shaft 22. The GST 40 comprises a cape 42, comprising a flexible vinyl fabric material 44 formed with an exterior edge 46 defining a substantially symmetrical shape 48 when the cape is extended outwardly or laid substantially flat, as on the ground or on another substantially flat surface. A connection portion 56 of the cape is generally centrally located. A first opening 50 may be formed through the cape 40 generally centrally located and sized for allowing the golf club head 30 to extend through the first opening 50. A second opening 52 may comprise a slit that is cut through the cape 44 extending from the exterior edge 46 inward toward the first opening 50 and to a position 54 adjacent to and spaced apart from the perimeter 58 of opening 50. According to this embodiment the connection portion 56 of the cape material is thereby defined by intact material between the first and second openings. A releasable fastener 60 such as a strap 61 with hook and loop attachment mechanism secured thereto may be provided for use to attach the cape 44 to the shaft 22 of a golf club 20. Based upon the disclosure herein, those of skill in the art will recognize, that other structures for forming a connection region generally centrally located on the flexible cape, for example first and second openings of other sizes, shapes and constructions for receiving the club shaft therethrough, might be used to form a connection region therebetween for removably attaching the flexible cape to the neck of the club shaft according to the present invention.

Figure 2:
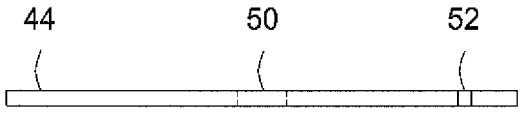
FIG. 2 is a side view of one embodiment of a golf swing trainer prior to installation on a golf club.

With reference also to FIG. 2, one embodiment of an embodiment of a GST is shown in a side view prior to installation on a golf club 20. It will be understood that the flexible cape material 44 comprises a thin, flexible sheet of materials such as a fabric. It has been found that the flexible cape material 44 may usefully comprise a material such as a polymeric sheet or vinyl sheet materials, for example PVC sheet material. It has been found to be particularly useful to use a vinyl fabric, a vinyl coated fabric material, a PVC or other polymeric material with a fabric backing, or a material sometimes known as "patent vinyl" that may have a slightly rough or textured surface resembling leather for upholstery and having a fabric backing. Particularly useful is a vinyl fabric of the type having a woven fabric backing. The characteristics of flexibility, surface texture, weight, and durability can all be usefully selected for the functions of the invention as described herein. For example, the slightly roughened surface of vinyl fabric and woven fabric backing provide for flexibility and also wind resistance together with a light to medium weight for momentum as will be described herein. It has been discovered by the inventor that a useful thickness for a vinyl fabric might be between about 4 mils and about 20 mils (between about 0.1 mm and 0.50 mm). One useful embodiment comprises a vinyl fabric having a thickness of about 10 mils and a weight of about 10 ounces per square yard (about 13 oz per running yard for 54 inch wide vinyl fabric material).

The symmetrical shape 48 of the cape usefully provides a uniform wind resistance and uniform weight distribution when the GST is used. In one or more embodiments the shape may be bilaterally symmetrical about a line drawn through a center of the shape of the cape material 44, for example along an imaginary line extended in either direction from the connection region 56 described herein. In a one or more embodiments, the shape may be a radially symmetrical shape, as for example, a uniform polygon, a uniform polygon with rounded corners or a circle to provide for a substantially uniform draping of the cape behind the moving club 20 during use so that the wind drag and the weight momentum are smoothly applied to the club used with the GST 40 device.

In one or more embodiments the total weight of the GST 40 may be between about 0.1 lb and about 1.0 lb (about 0.45 N to 4.5 N) depending primarily upon the weight and size of the flexible fabric material forming the cape 44. In one example, it has been found useful for the cape to be made of a vinyl fabric about 10 mils (about 0.25 mm) thick, having a weight of about 10 ounces per square yard (about 13 ounces per linear yard for 54 inch width), the weight of the cape and fastener 60 together might be estimated to total about 0.3 lbs (about 1.3N) for a circular shaped cape with a radius of 16.5 inches (about 42 cm) and a circular opening having a radius of about 1.5 inch (3.8 cm). In another embodiment, for example for a smaller golfer, the cape 44 with a regular octagonal shape having a maximum radius of about 12 inches (30.5 cm), a first circular opening having a radius of about 1.5 inch (3.8 cm), and made of vinyl fabric having about 10 mil thickness and a per square yard weight of about 10 ounces, the total weight may be estimated to be about 0.15 lbs (0.67N).

In one or more embodiments the first opening may be generally centrally located in the symmetrical flexible vinyl fabric material. The first opening may be sized for receiving the club head of the golf club therethrough. A second opening, sized to allow a golf club shaft to extend therethrough may be formed by a slit cut in the symmetrical flexible thin vinyl material extending from exterior edge of the symmetrical shape inward toward the central opening. A portion of vinyl material centrally located and extending between the first opening and the second opening formed by the slit forming between the slit and the central opening forming a connection region defined by a portion of vinyl material of the cape between the slit and the generally centrally located opening. While the first opening may be formed substantially in the center of a radially symmetrical shaped cape for convenience, it may also be formed centrally located and yet slightly offset from the exact center so the connection region of the cape will be more nearly at the center of the symmetrical shape of the cape. When the cape is fastened to the golf club shaft at the connection region, it will be due to the uniform symmetrical shape drape uniformly from the golf club shaft when in use.

It has been found that for most golfers a GST with a maximum radial dimension in a range of about 20 cm to about 45 cm (about 8 inches to about 18 inches) will be useful for purposes of embodiments of the invention.

Figure 3:
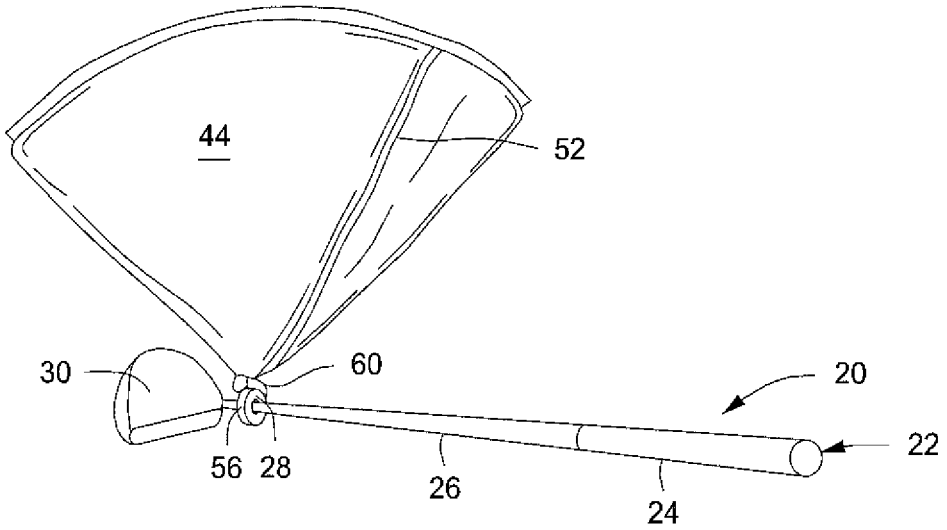
FIG. 3 is a partial perspective view of one embodiment of a golf swing trainer installed on a golf club.

In one or more embodiments, as shown in the partial perspective view of one embodiment of a golf swing trainer installed on a golf club in FIG. 3, the fastener 60 may comprise a strap sized for removably securing the cape to the golf club with the club extended through the first and second openings with the club head in one direction and the club shaft extending in the other direction from the fastening point between the openings. The connection region will be overlaying the neck with the cape draped adjacent to the shaft of the club, the middle region of the shaft may project through the slit and the fastener strap is wrapped around the vinyl material of the connection region bunched loosely to allow pivoting around the neck of the cub shaft thereby holding the cape onto the shaft of the club at the neck adjacent to the club head. While a snap of other fastening mechanisms might be provided, it has been found by the inventor to be useful to use as a fastener a strap with hook and loop detachable connection material secured thereto so that the fastener is easily removable and it is also adjustable to secure the cape so that it may pivot about the golf club shaft by the forces of wind resistance, dynamic momentum and centrifugal force when it is attached and in use for during golf swing training.

Figure 4:
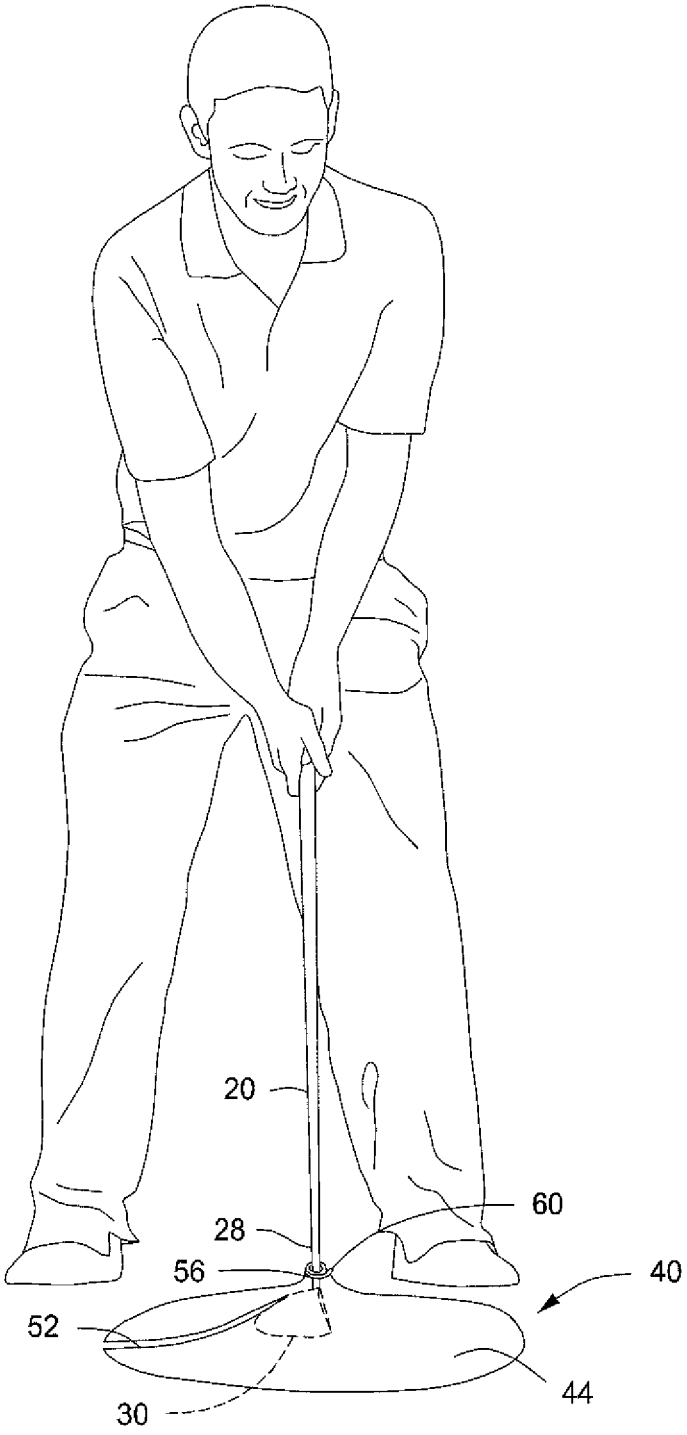
FIG. 4 is a perspective view of a golf swing trainer attached and with the cape draped over the club head ready for initiating a training golf swing using the golf swing trainer according to one embodiment of the invention

In an embodiment shown in FIG. 4 a golf swing trainer 40 is attached to a golf club 20 and the golf club is held by a golfer in a club to ball impact or an address position prior to beginning a backswing or a takeaway swing. The cape 44 is positioned draped over the head 30 of the golf club 20 with the exterior edge arranged and generally supported by the ground adjacent to the club head. The golfer is generally "square" to the ball impact position (i.e., with shoulders generally perpendicular to the ball and aligned in the direction of intended ball travel), wherein the ball may be straight in front of the golfer or only slightly ahead of the golfer in the intended direction for the ball.

Figure 5:
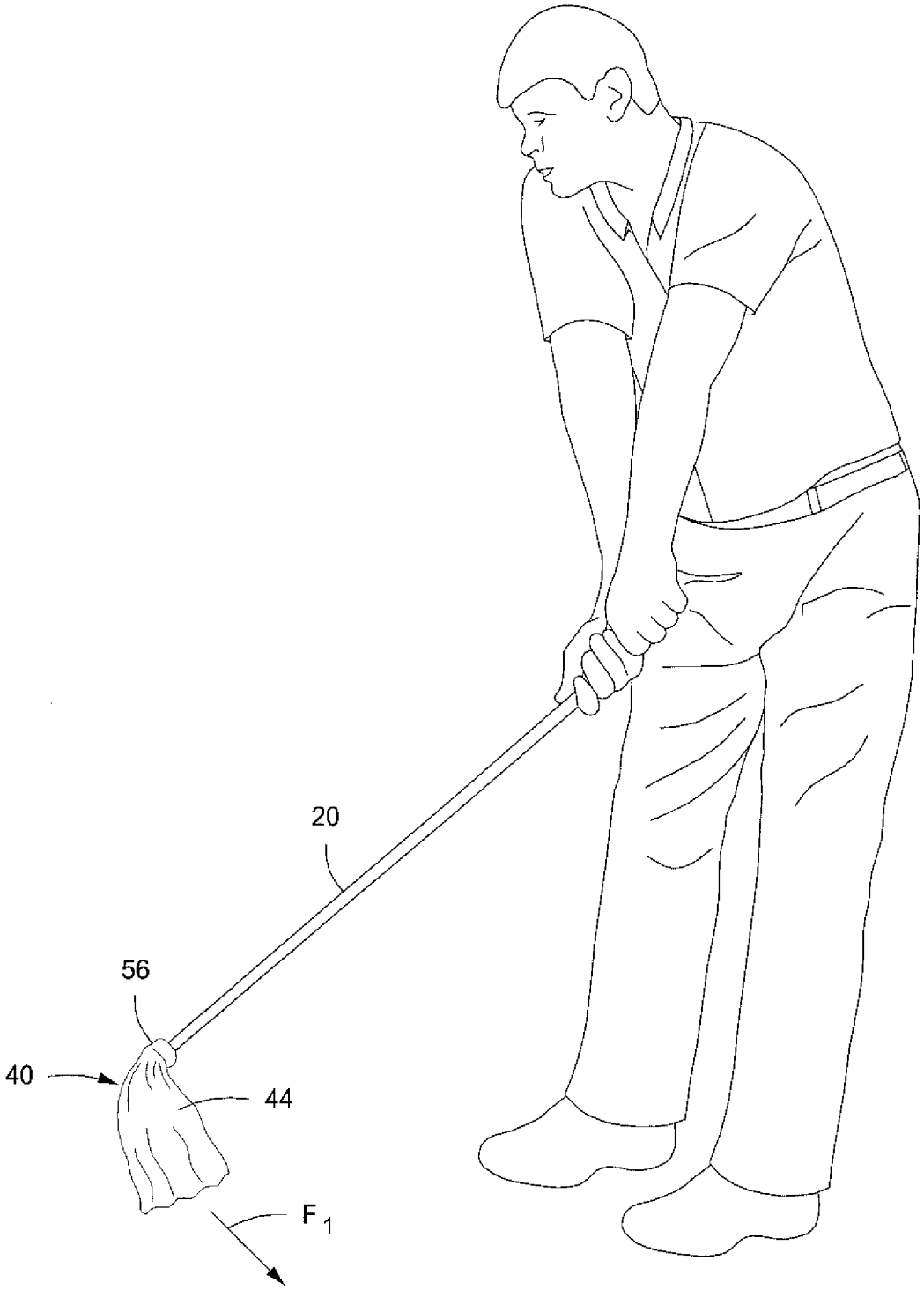
FIG. 5 is a perspective view of a "takeaway" or backswing portion of a golf swing using a golf swing trainer according to one embodiment of the invention.

FIG. 5 show a perspective view of a "takeaway" or backswing portion of a training golf swing using a golf swing trainer according to one embodiment of the invention. In this embodiment the flexible cape drapes uniformly over the head of the club. This provides a vector force F1 due primarily to light wind resistance force and partially due to the momentum of the cape (i.e. the force required to accelerate the added mass of the cape) both forces directed generally perpendicular to the club shaft as it is swung rearward. The added force vector in the perpendicular direction encourages a proper smooth slow and deliberate takeaway for a backswing that is not jerked back abruptly. By the GST structure in the form of a flexible sheet the golfer may work to keep the flexible sheet uniformly draped over the head of the golf club thereby requiring a smooth straight back motion to do so. This helps to train the gofer to make a good backswing. It might also be understood that at the relatively slow speed of the takeaway or initial part of the backswing, there is generally only a slight, relatively insignificant effect of centrifugal force caused by the mass of the cape, and thus the direction of the force vector imparted by the GST is substantially perpendicular to the club and thereby encourages a uniform straight rearward swing motion.

Figure 6:
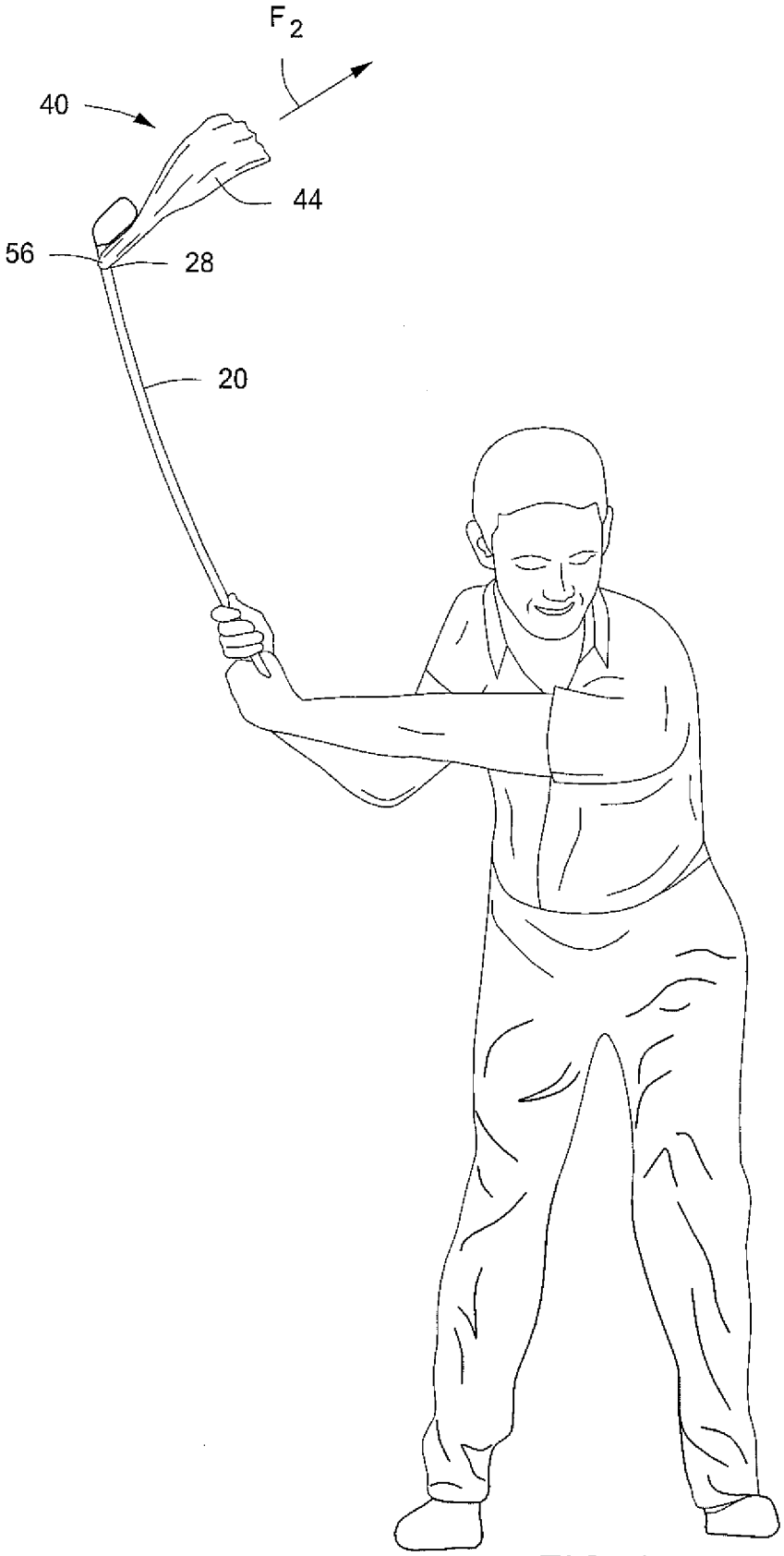
FIG. 6 is a perspective view of a downswing portion of a golf swing using a golf swing trainer according to one embodiment of the invention.

FIG. 6 is a perspective view of a downswing portion of a golf swing using a golf swing trainer according to one embodiment of the invention. At the initial stages of the downswing the force vector F2 additionally generated by the inventive GST is generally perpendicular to the club shaft due to the wind resistance and the acceleration of the cape. There is a slight outward component due to the centrifugal force of the mass of the cape as well. The golfer feels this additional "pull" on the golf club with each training swing and learn to make the appropriate hip rotation HR and other body movements to compensate for overcoming the added force. During training the added force becomes expected and the golfer learns to anticipate it in the swing. As the speed and the acceleration of the downswing of the swing increases from the upper part of the swing to the lower part of the swing the wind resistance force and the total resultant force increases as well. The natural reaction to overcoming the added force when it is expected is to improve the mechanics of the golf swing as will be discussed more herein.

Figure 7:
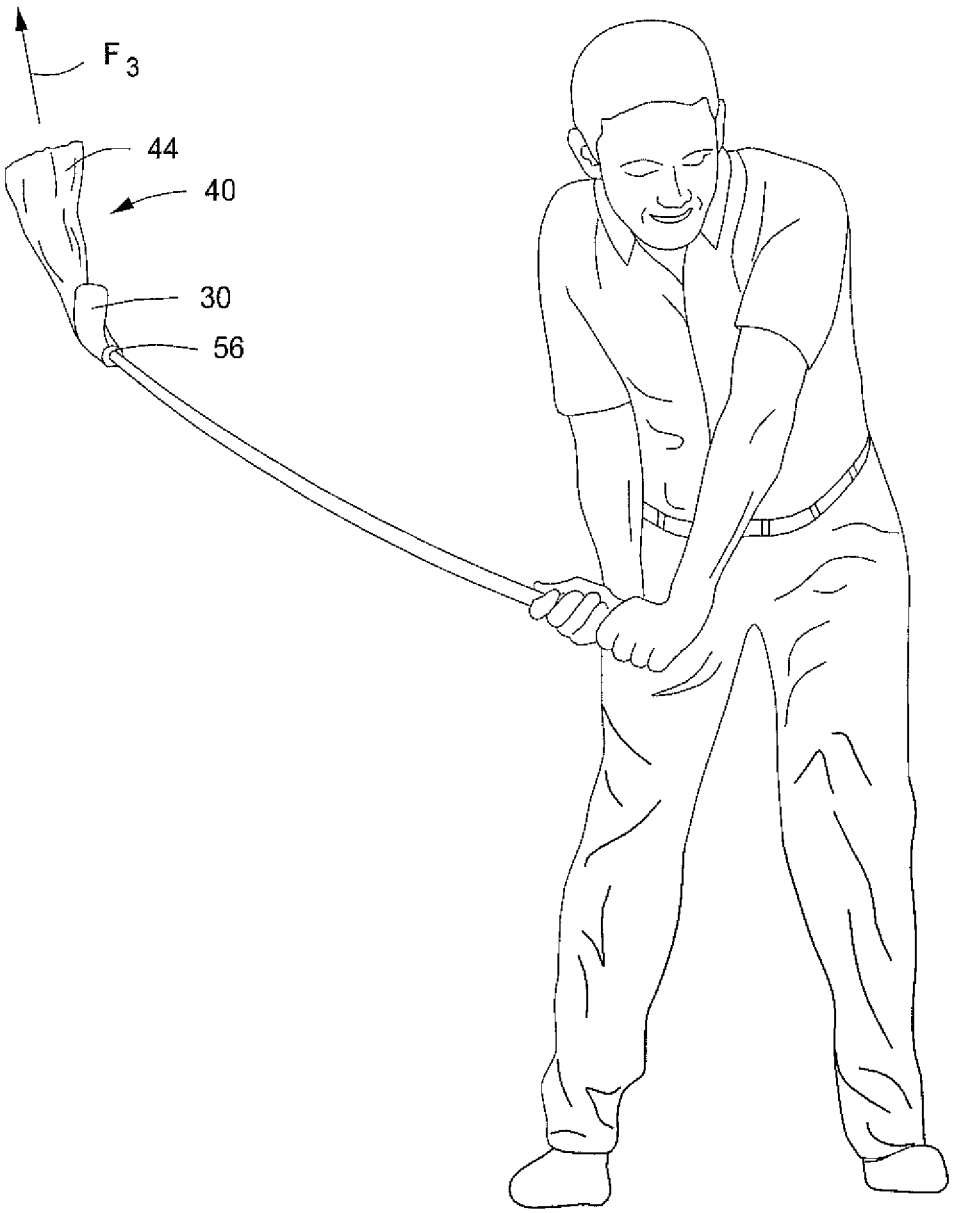
FIG. 7 is a perspective view of a downswing portion of a golf swing using a golf swing trainer shortly prior to the "release point according to one embodiment of the invention".

FIG. 7 is a perspective view of a downswing portion of a golf swing using a golf swing trainer shortly prior to the "release" point according to one embodiment of the invention. As the speed of the swing increases the wind resistance caused by the cape continues to increase and the rate of acceleration increases only moderately. The rotary speed, however, begins to cause the centrifugal force directed radially outwardly to become a more significant factor and the resultant force vector F3 from the GST is both rearward and outward. This presents an additional feel to the golfer where to prepare to allow the golf club to rotate at the golfer's wrist or as it is known to prepare to "release" the club to further swing forward in the direction of movement about the fulcrum of the wrist thereby imparting additional speed to the head of the golf club prior to striking the ball. The additional centrifugal force provided by the GST thereby enhances the golfer's feel for this phenomenon and at the correct time during the swing. By repeated swings with the GST the release point becomes known and remembered (muscle memory) by the golfer.

Figure 8:
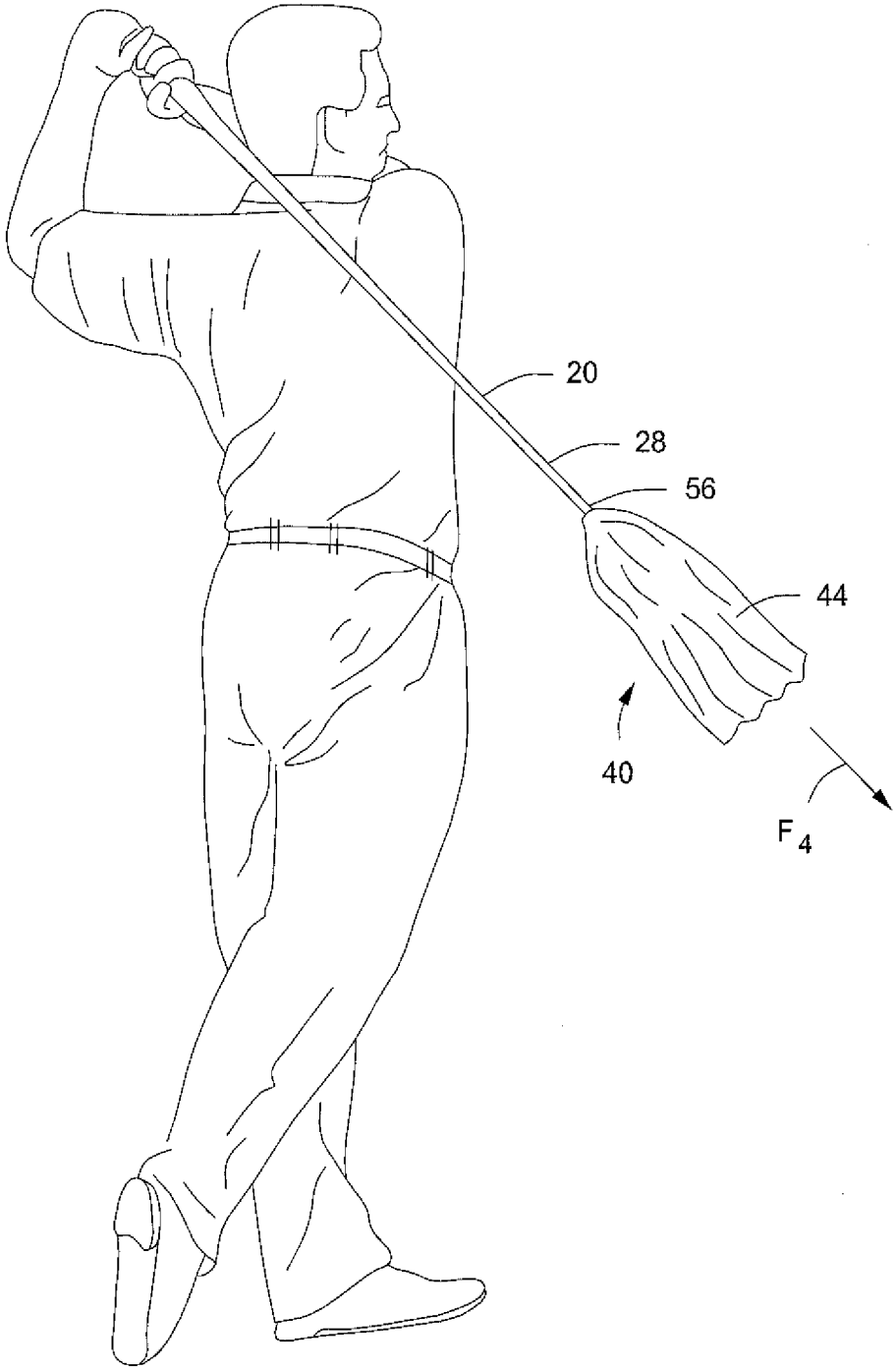
FIG. 8 is a perspective view of a completed follow-through portion of a golf swing using a golf swing trainer according to one embodiment of the invention.

FIG. 8 is a perspective view of a completed follow-through portion of a golf swing using a golf swing trainer according to one embodiment of the invention. It will be understood upon reading this disclosure that the added momentum of the GST helps to carry the club past the ball impact point and continues to the completed follow-through. As the golf club must be slowed down in the follow-through the added mass of the GST pulls club and the golfers body further before the club comes to a stop. The additional rotation naturally encourages the golfer to make and to learn to make a complete full rotation follow-through. It may be noted that when the club head slows during the follow-through swing the wind resistance force on the cape becomes less significant, the cape rotates radially outwardly and the resultant force vector is generated primarily from the outward momentum force that is directed to pull the club initially forward and generally perpendicular to the club and as the club slows further the cape rotates relative to the club shaft and pulls radially outwardly as at F4. Thus, the golfer is naturally encouraged to follow through in a full rotation.

According to one or more embodiments, a method is provided by which a person, such as a golfer, may use the golf swing trainer according to steps that will facilitate the golfer learning how to make a proper golf swing and/or training the golfer to improve a previously learned golf swing. In one or more embodiments the user applies the golf swing trainer to the head end of the golf club shaft, usefully at the neck of the golf club shaft at which the club head is connected at one end of the club shaft. The user holds the golf club by its existing grip and executes several complete swings, (usefully about 10 complete swings) with the golf swing trainer device fastened to the golf club. The user removes the GST (or uses an identical club without the GST attached) and executes a fewer number of swings (usefully about 2 swings) without the golf swing trainer. In one embodiment the 2 swings without the GST follow the 10 swings with the GST. The user also may also usefully hit a small number of balls (usefully in this example one ball) without the GST attached. While the users of this GST device and method might not be professional, avid or proficient golfers, particularly when they start to learn to play, the user will be referred to as a golfer or the golfer for convenience of understanding.

Repeated swinging of the golf club with the GST attached will develop muscle memory as the golfer's body (and the automatic mental control of the muscles) "learns" the proper sequence to maximize efficient power. The trainer device and method of using the trainer is useful without actually hitting a golf ball during the practice swings with the trainer attached to the golf club. Interposing the steps of removing the trainer from the golf club and swinging the golf club to actually hit a ball, without the trainer attached, will facilitate translation of the proper movements to the golfer's learned golf swing. The habitual coordination of the movement of legs, hips, torso, head, shoulders, arms, wrist, and hands between the golfer's brain and the multiple muscles involved is sometimes referred to in sports parlance as "muscle memory." The process may be repeated and over time and the muscle memory of a good golf swing will continue to develop as the golfer's body continues to learn and to confirm the proper sequence and form to maximize efficient power and accuracy. Just like any habit, it takes time and repetition to permanently fix, so practice is required.

According to one or more embodiments of the present invention, the golf swing trainer encourages good form during a backswing, forces the golfer to have proper tempo initial movement, an on-plane takeaway, an active hip turn leading the sequence of a downswing, it maintains a desirable "lag" of the club head behind the golfer's hands during the downswing, and then the momentum and centrifugal force pulls the club into a nice finish position with the golf club ending the swing behind the golfer's head.

Backswing

A proper backswing establishes a body position that allows the golfer to maximize potential bio-mechanical energy for transfer to the downswing. A proper body position also minimizes the amount of compensations that the body has to make to impact the clubface to the ball. A golf swing as described herein begins after properly gripping the golf club and alignment of the face of the club at a point of intended impact with a golf ball. It is generally accepted that a proper takeaway, the initial part of the backswing that begins with the golfer holding the club at the point of intended impact with the ball from a starting position with the golfer club face directly adjacent to the ball and at the rear of the intended club to ball impact point and drawing the club rearward. A good takeaway will include the following elements—a low and slow initial movement from the ball, having an "on plane" takeaway, and maintaining proper tempo.

Initial Movement of Backswing

The initial low and slow movement will be a rearward movement of the club perpendicular to the club face and away as the ball begins. A good swing will start with a "one piece"

takeaway. This means that the shoulders, arms, and club all turn simultaneously at the beginning of the movement. (See FIG. 5) Initial movement of the club through wrist hinge is not desirable.

For a low and slow initial movement, golf instructors will often attempt to convey or explain a mental image or "feel" to their student golfers to facilitate a low-slow takeaway. The problem with this is that the instructions are dependent on the student's understanding and interpretation of what that "feel" is. For example, a common practice is to tell the golfer to take the club back from the ball as if he was putting the head of the club into the mitt of a baseball catcher. For some, this may be difficult to envision and also leaves room for execution error based on the student's perception of where that imaginary mitt is mentally located relative to the ball.

The golf swing trainer device according to one or more embodiments gives the golfer a physical objective instead of the mere mental image and effectively provides a "feel" due to forces applied to the golf club resulting from movement of the golf swing trainer. The physical objective provided according to one or more embodiments of the invention is for the golfer to move the club so that the material drapes over the club. This physical act with the trainer gives immediate feedback if the club is moved in an improper motion and the golfer does not get the trainer draped over the club as desired. If the club is started back by the wrists, the small muscles of the wrist of the golfer will need to apply extra force to accelerate the mass of the trainer device. The golfer immediately feels an unexpected increase in weight because the golfer is using the small muscles of the forearm to lift the club instead of using the big muscles of the shoulders and back to rotate the club away. With only the weight of the club and particularly after a golfer has already developed a bad habit of initiating takeaway using the wrists, the golfer will not usually notice the undesired initial wrist action. The added weight of the trainer and then the wind drag that is expected from the properly draped golf swing trainer encourages the use of the big muscles of the back and shoulders.

On-Plane Backswing

An on-plane backswing is important to positioning the club so that a minimal plane change is needed to get the club head back to the ball during the downswing. Minimal plane change increases accuracy and consistency of the golf swing. One way to measure the progression of the club during the backswing is to observe the golfer from the golfer's side (right side for a right handed golfer and left side for a left handed golfer), behind the ball and as if looking toward the target. During the backswing, a club moving on the correct plane will be immediately to the golfer's side and rearward of the ball (to the observer it will appear as if the club head will be superimposed on the hands as the club shaft reaches a position parallel to the ground. The golfer's club should "cover up" his hands from the observer's point of view, or at least the club should appear to be in close proximity to covering the golfer's hands. A club moving in an incorrect plane will be significantly behind or in front of the hands at the same point and the hands of the golfer will be clearly visible to the target looking observer.

Achievement of this position is difficult to instruct in real time. Meaning, a golf coach cannot provide instructional inputs fast enough during the backswing to affect a proper corrective change. The golf trainer device is able to provide real time feedback to the golfer through the feel of the club in the golfer's hands as the takeaway is progressing. If the club is started back correctly with a one-piece, low-slow takeaway as described above, the material of the trainer device will be proportionally draped over the club head. An on-plane takeaway maintains an unchanging angle of attack and the same relative wind on either side of the club shaft. The wind resistance of the golf swing trainer device exerts proportionally equal force on each side of the draped material and helps to maintain the golf swing trainer in position on the club with positive pressure on the golf club grip and without any detectable rotational torque in the hands of the golfer. If the takeaway is not on plane, or if the club is improperly rotated during the takeaway, the material of the golf swing trainer will fall off the club or will place detectable rotational or unbalanced force on the grip due to a combination of unbalanced wind resistance, gravitational, and momentum effects caused by a changing angle of attack or an off plane takeaway movement. This gives the golfer immediate notice that the backswing was not performed in a correct manner.

Tempo

Many golfers have been told that a good swing tempo is important to a proper swing. One part of that tempo is the backswing. Some golfers swing back too fast, while others swing back too slowly. The golf swing trainer has normalizing effects on both conditions. For fast back-swingers, the added weight of the golf swing trainer and the objective of keeping the material draped over the club tend to slow down the takeaway. For slow backswingers, if there is not enough wind resistance to maintain positive pressure of the material against the club the golf swing trainer will tend to fall off the club head. The golfer is thereby encouraged, by the objective of keeping the golf swing trainer in proper position and the feed back "feel" from the golf swing trainer, to speed up the swing to meet that simple physical objective. The backswing continues, with the body, hips and torso rotating the shoulders and carrying the arms on-plane up and behind the golfer's head. One way to visualize this effect is to consider the golfer's body as being wound-up, on-plane, like a spring ready to unwind on the downswing. The forward arm remains extended outward, straight or only slightly bent at the elbow, the rear arm bends naturally at the elbow and the wrists bend naturally as the golf club is carried back making an acute angle of 45 to 30 degrees relative to the forward arm. This moves the golf club to an instantaneous position of "rest" behind the golfer's head, above the shoulders and approximately parallel to the ground before reversing the swing direction to the downswing.

Downswing—Hip Rotation—Swing Sequence

In observations of professional golfers, one commonality appears to be that these good golfers all have essentially the same or at least a very similar downswing sequence. The sequence that is common to the good golfers begins with the lower body. Some instructors teach that the swing should start from the ground up, namely the legs, hips, torso, shoulders, arms and hands. Sequence is important; both as to the order and also as to the separate actions and the sequential timing of one body part moving after another body part. This is sometimes called "sequence and separation" between the separate swing actions. It is initiated by the feet and legs and a movement of the target side knee toward the target. It has been found by the inventor that a major key to a fast and powerful swing is the rapid movement of the hips. The hips are turned or rotated in a direction toward the target. It might be understood that the hips are only a short distance some estimate about 3 inches from the central axis of the body and ultimately the axis of rotation of the head of the of club that is at a distance of about 75 inches from the axis of rotation. Thus, if the movement speed of the hips is translated directly to movement at the golf club head it can have a 25 times multiplier effect. The movement of the hips is desirably followed by rotation of the torso that in turn rotates the shoulders. The backswing rotates the shoulders back and "winds up" the torso that then unwinds on the downswing. The arms are generally relaxed during the initiation of the downswing, and in sequence following the torso and shoulders, the arms extended as they are moved by the torque of the torso twisting the shoulders. At a certain point, generally after the arms have reached a position parallel to the ground, the club is "released" by the wrist and the club head moves outward due to centrifugal forces, thereby rotating about the wrist in the direction forward so that the lagging club head effectively catches up with the hands. (There is some contention amongst purist physicists that the cause of this action is actually the centripetal force. It might be considered that in the first part of the downswing there is an amount of inward directed centripetal force that is applied by the golfer's wrist to hold the club head in a lagging position and thus not fully extended to the maximum possible diameter swing of the fully extended arms and radial golf club shaft. When the club is released and the wrist need not apply the inward centripetal force, the club head simply moves unopposed outward, as if an equal amount of outwardly directed centrifugal force caused it to move. Whether, the cause is properly termed centrifugal force or centripetal force the real world effect is the same; upon release of the club head it moves outward in a radial direction and it thereby rotates forward in the direction of movement relative to the pivot point of the wrist. The lag is recovered and the club head accelerates toward impact with the ball.) The additional forward swing rotation of the club head might theoretically be at a maximum speed when the club head reaches the maximum on-plane rotation diameter of the golfer's extended arms. It is also generally recognized that this should correspond to the point of impact with the ball for maximum speed of the club head at impact.

Many amateur golfers have a tendency to follow an incorrect swing sequence. One type of incorrect swing sequence starts in the entirely wrong order; starting from the upper body, the arms and shoulders, and progressing to the lower body, the torso, hips and legs. Commonly, an incorrect swing sequence might move all parts of the body simultaneously, groups of parts of the body simultaneously, might not start the lower body movement soon enough, or might activate the movement sequentially from one part of the body to the next too slowly for achieving maximum power.

The inventor has discovered that in many cases the incorrect sequence may be the result of the golfer having sufficient strength to move the lightweight club to hit the ball with some amount of force, even though the sequence is incorrect and does not maximize the force that might be possible for the golfer. It might be considered that a golf club is a very light device by design. Because a golf club is relatively light, many golfers have the ability to maneuver it using relatively weak muscles, namely, any of their back, arm, wrist and hand muscles that are strong enough to do so, even though the muscles used are not the best or strongest muscles for a desired movement. To visualize this concept, one might imagine picking up a pencil off the ground. One can use back muscles to simply bend over and pick up the pencil, even though we are all told to "lift with your legs, not your back". Because it can be done for a light object using only the relatively weak back muscles, the brain allows the body to accomplish the objective of picking up a light object using the relatively weak muscles, even though for maximum lifting the leg muscles would be a better choice. If the object to be picked up was heavy, for example, a 300 lb. weight, few people could pick it up using only the weak back muscles. The person's body naturally knows (even without consciously thinking about it in most cases) that it would not be "right" to bend over and try to pick it up with the back muscles. Assuming that the person's activities had some experience involving lifting activities for a frame of reference, and assuming there was not a recent change in body strength, a person faced with lifting an obviously heavy object would naturally lift it with their legs. Subconsciously, the person's body naturally "knows" through "muscle memory" to bend the legs and use the large thigh muscles and keeps the back erect in order to accomplish the brain's objective of lifting the heavy object.

It has been theorized by the inventor that the golf swing trainer induces the proper downswing sequence, at least in part, for a similar reason. Because the golf swing trainer applies sufficient forces, the golfer's body learns through use that in order to make a fast swing of the golf club with the golf trainer in place the golfer must make the swing using the larger stronger muscles that can do so. Also, the sequence of muscle application that is required must be the sequence that provides the most efficient movements. Thus, proper strong muscle and sequential activation of those muscles are naturally employed by the golfer to compensate for the increased resistance forces that are applied by the golf swing trainer. (See discussion of the golf swing trainer generated forces at Force Calculation Section herein.) By repetitive training with the golf swing trainer in place, habit and muscle memory again makes it natural to use the same muscles and the same sequence for an actual golf swing.

For further demonstration that human bodies "know" how to overcome increased resistance in a golf swing, an experiment might be conducted as follows. One may stand in a doorway facing one of the sides of the doorway frame with feet positioned a shoulder width apart. With the objective of pulling the wall down into one of the rooms, the person is asked to grab the door frame with both hands and try with all their strength to pull the wall into the room, like a He-Man. The person's body will know that it cannot accomplish this task of great strength using only the arms. The person's hips and torso will most naturally turn into the intended direction of the pull as and ahead of the arm pull as the person's body attempts to generate maximum power for the heavy task at hand.

Downswing—Club Lag

Golf instructors often want their students to develop proper club lag. Club lag may be understood as the distance or the angular offset by which the club head follows the golfer's hands during the swinging of the club. Others might assert that they have a device that will "teach" their student how to create lag. In most, if not all such cases, the devices might only show how much club lag exists in the student's golf swing. It does not show how to create the club lag. Devices that only evaluate whether or not a student's swing generates club head lag, do not actually teach the correct way to do it. There is a significant difference between teaching and evaluating. The golf swing trainer applies drag forces to the golf club during use. The drag forces are generated by wind resistance when the hands swing the club forward through the air and this effectively "pulls" the club head behind the hands during the top part of the downswing. Due to the construction of the golf swing trainer according to one or more embodiments of the invention, the drag forces are applied directly to a point on the club shaft directed straight back and without any club shaft twisting. The drag thereby forces the wrists, the arms and the shoulders to create the desired club head lag. The primary wind drag force is specifically applied at the head of the club so that it effectively teaches the golfer how to position the body parts, throughout the swing, to create and maintain desirable club head lag. Through practice, with the club head forced into a club head lag position during the practice swings, the golfer learns by feel and muscle memory how to reproduce the positioning of body parts during an actual golf swing so that club head lag is created.

To further understand how the golf swing trainer teaches the golfer to generate club lag, it is helpful to understand what causes the club head lag to be created. Ultimately, club head lag is the result of a swing that starts with a properly sequenced hip turn. This might be understood by considering a method of teaching proper golf swing called "Swing Machine Golf." In this teaching method, the teacher recommends that one should model their swing after a golf swing machine because it is mechanically consistent with each swing identical to each other swing, and thus it might be considered to be the most consistent golfer ever. One of the key concepts to understand about the swing machine is that the joint representing the human's wrist is a free moving hinge. Meaning, there is not any mechanical or rotational input placed on the club at the mechanical wrist joint, yet the machine is able to create club lag and proper release timing. The club lag is a result of the torque created by the machine at the "shoulders" of the mechanical swing arms.

For the human golfer, club lag starts at the top of the backswing where the golfer's wrists are cocked to approximately a 90 degree angle relative to the arms. A rapid acceleration of the hands causes the club to hinge outward by the effect of centrifugal force on the golf club and particularly by the centrifugal force on the head of the golf club. A goal for a good swing is to ultimately generate rapid hand speed. The rapid hand speed is provided by swinging the arms rapidly with the shoulders. Thus, a rapid shoulder turn leads and provides the rapid arms and hands movement. A rapid shoulder turn is created with rapid torso twist that leads the shoulder turn. The fastest possible torso twist is created with a rapid hip turn that leads the torso twist. As indicated previously, the speed of the hip turn can be multiplied by a large number at the hands and an even larger number at the club head. For a truly good, fast, and powerful golf swing, each leading movement is the "cause" for each following movement or the "effect". It is a goal to have a desired timing sequence and separation and to learn how to swing so that each leading movement anticipates and transitions smoothly into the next movement. The movements must be in a cause and effect sequence and must be smoothly connected one to the next: hip turn, torso twist, shoulder turn, arms, wrists, hands and golf club swing. At the top of the backswing the wrists are bent so the club is at an acute angle to the arms. The angle may be maintained at about 90 degrees or less for the first of the downswing portion to maintain the club head lag as discussed above. At an appropriate point in the golf club swing, the point at which there is sufficient centrifugal force on the club, the wrist releases and pivots. With the centrifugal force and momentum, the club head is thereby additionally accelerated forward relative to the moving wrist and hands and to a faster speed for impacting the ball.

FIGS. 9A, 9B, and 9C schematically depict diagrams for the top of the backswing at a position where the angle of the club shaft is about minus 220 degrees relative to a perpendicular direction from the golfer to the ball impact point. This corresponds to the position of the club behind the golfer's head at the point, after the backswing, for reversing the direction to start the downswing. In FIG. 9A, a theoretical position of the golfer's hips and shoulders is depicted. In FIG. 9B, a dual hinge link arm model of the shoulder, arm, club, and golf swing trainer system presenting theoretical estimated vector forces imparted by the golf swing trainer is estimated according to one or more embodiments. In FIG. 9C, theoretically determined club head speed, drag from the GST, momentum and centrifugal force values imparted by the GST are indicated.

FIGS. 10A, 10B, and 10C schematically depict diagrams for a downswing initiation position of the downswing where the angle of the club shaft is about minus 160 degrees relative to a perpendicular direction from the golfer to the ball impact point. This corresponds to the position of the club moving downward in a downswing. In FIG. 10A, a theoretical position of the golfer's hips and shoulders is depicted. In FIG. 10B, a dual hinge link arm model of the shoulder, arm, club, and golf swing trainer system presenting theoretical estimated vector forces imparted by the golf swing trainer is estimated according to one or more embodiments. In FIG. 10C, theoretically determined club head speed, drag from the GST, momentum and centrifugal force values imparted by the GST are indicated.

Figures 11A, 11B, 11C, 12A, 12B, 12C:
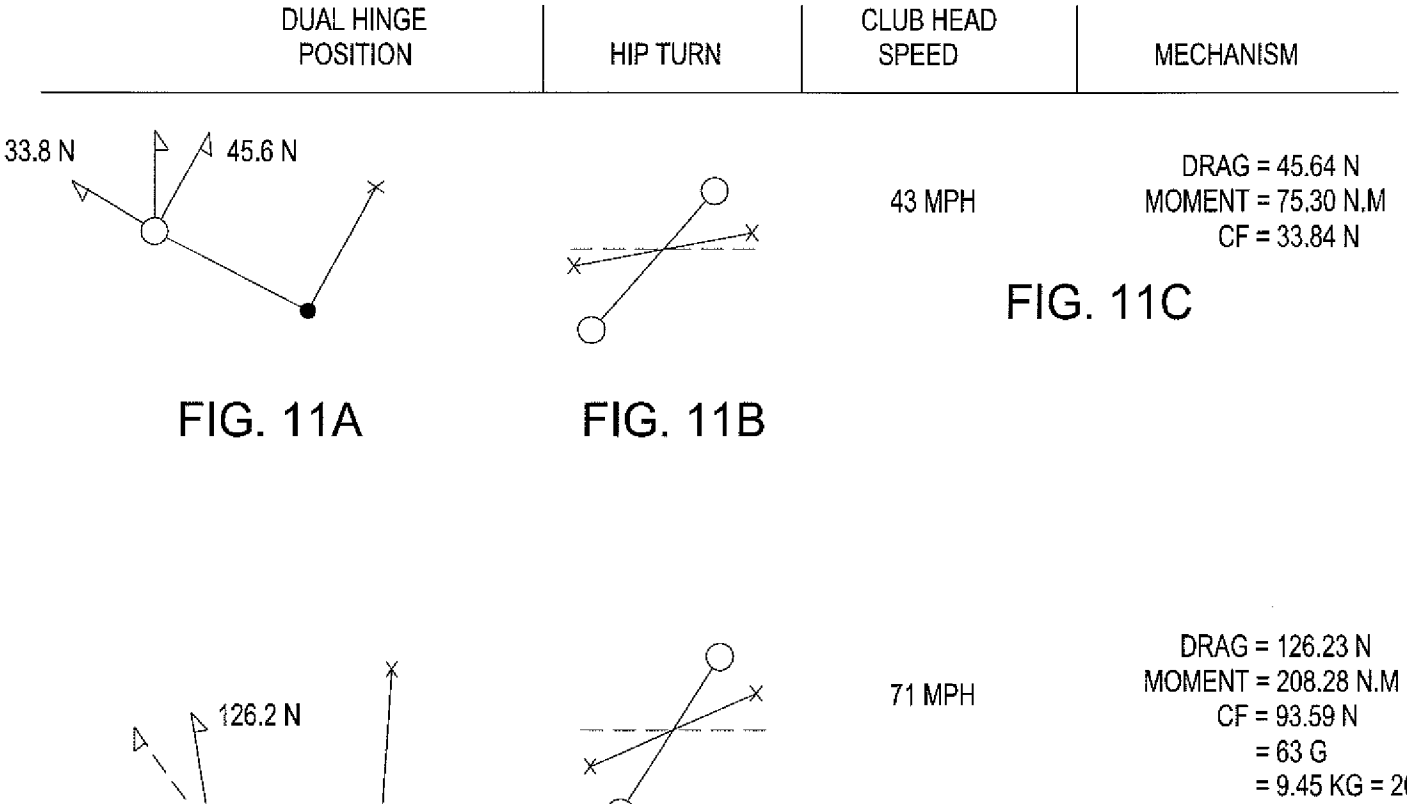
FIGS. 11A, 11B, and 11C are schematic depictions of diagrams for a middle position of the downswing showing, in FIG. 11A, a theoretical position of the golfer's hips and shoulders, showing, in FIG. 11B, a dual hinge link arm model of the shoulder, arm, club, and golf swing trainer system presenting theoretical estimated vector forces imparted by the golf swing trainer according to one or more embodiments, and showing in FIG. 11C theoretically determined speed, drag, momentum and centrifugal force values.
FIGS. 12A, 12B, and 12C are schematic depictions of diagrams for a pre-release position of the downswing showing, in FIG. 12A, a theoretical position of the golfer's hips and shoulders, showing, in FIG. 12B, a link arm model of the shoulder, arm, club, and golf swing trainer system presenting theoretical estimated vector forces imparted by the golf swing trainer according to one or more embodiments, and showing in FIG. 12C theoretically determined speed, drag, momentum and centrifugal force values.

FIGS. 11A, 11B, and 11C schematically depict diagrams for a middle position of the downswing where the angle of the club shaft is about minus 120 degrees relative to a perpendicular direction from the golfer to the ball impact point. This corresponds to the position of the club rapidly accelerating in the downswing. In FIG. 11A, a theoretical position of the golfer's hips and shoulders is depicted. In FIG. 11B, a dual hinge link arm model of the shoulder, arm, club, and golf swing trainer system presenting theoretical estimated vector forces imparted by the golf swing trainer is estimated according to one or more embodiments. In FIG. 11C, theoretically determined club head speed, drag from the GST, momentum and centrifugal force values imparted by the GST are indicated.

FIGS. 12A, 12B, and 12C schematically depict diagrams for a pre-release position of the downswing where the angle of the club shaft is about minus 80 degrees relative to a perpendicular direction from the golfer to the ball impact point. This corresponds to the position of the club during the downswing at which the club head is moving at a high speed and in the range of the downswing at which the release of the club should be made. In FIG. 12A, a theoretical position of the golfer's hips and shoulders is depicted. In FIG. 12B, a dual hinge link arm model of the shoulder, arm, club, and golf swing trainer system presenting theoretical estimated vector forces imparted by the golf swing trainer is estimated according to one or more embodiments. In FIG. 12C, theoretically determined club head speed, drag from the GST, momentum and centrifugal force values imparted by the GST are indicated.

Figures 13A, 13B, 13C, 14A, 14B, 14C:
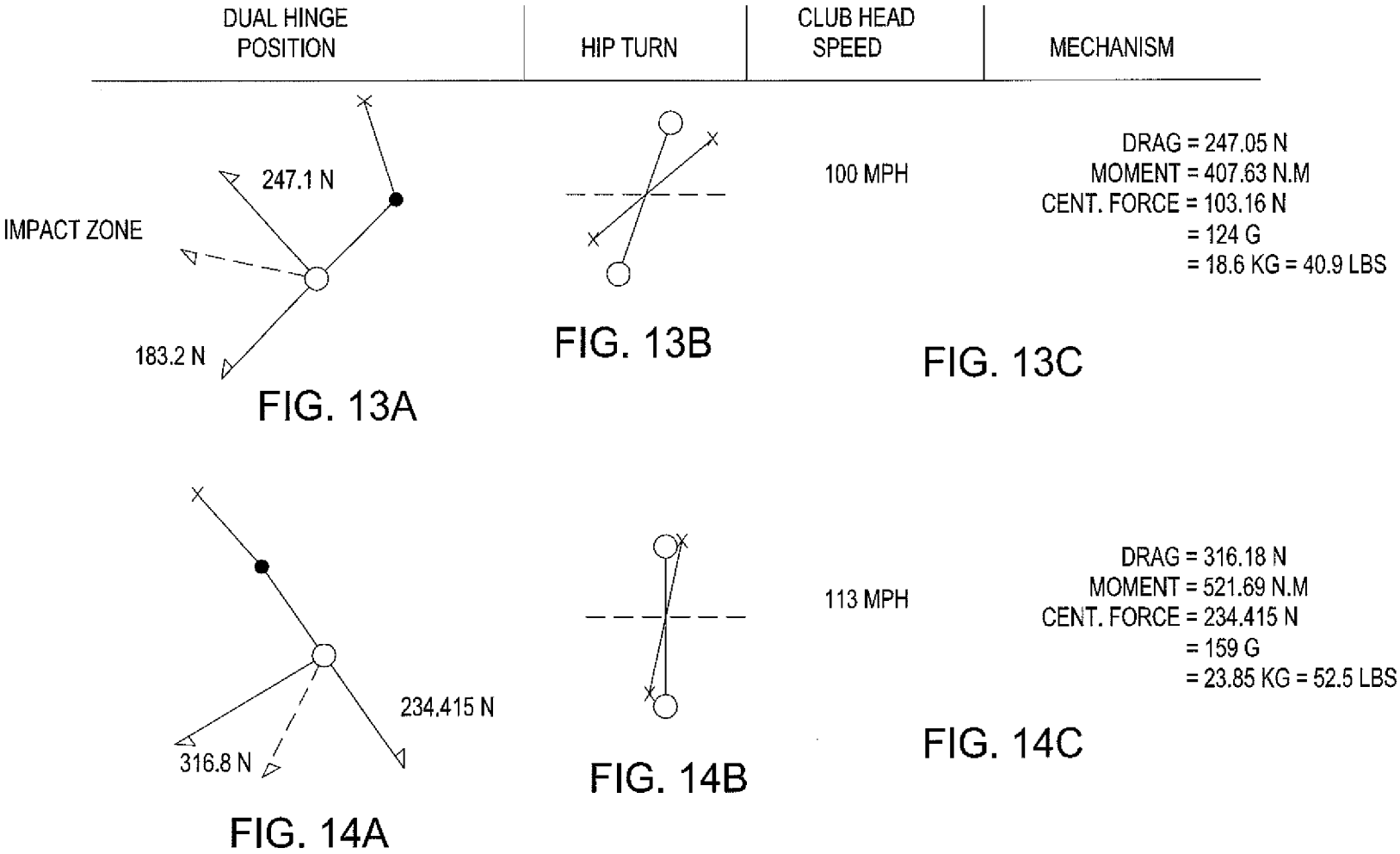
FIGS. 13A, 13B, and 13C are schematic depictions of diagrams for a post-release position of the downswing showing, in FIG. 13A, a theoretical position of the golfer's hips and shoulders, showing, in FIG. 13B, a link arm model of the shoulder, arm, club, and golf swing trainer system presenting theoretical, estimated vector forces imparted by the golf swing trainer according to one or more embodiments, and showing in FIG. 13C theoretically determined speed, drag, momentum and centrifugal force values.
FIGS. 14A, 14B, and 14C are schematic depictions of diagrams for an impact zone position of the downswing showing, in FIG. 14A, the theoretical position of the golfer's hips and shoulders, showing, in FIG. 14B, a link arm model of the shoulder, arm, club, and golf swing trainer system presenting theoretical, estimated vector forces imparted by the golf swing trainer according to one or more embodiments, and showing, in FIG. 14C, theoretically determined speed, drag, momentum and centrifugal force values.

FIGS. 13A, 13B, and 13C schematically depict diagrams for a post-release position of the downswing where the angle of the club shaft is about minus 30 degrees relative to a perpendicular direction from the golfer to the ball impact point. This corresponds to the position of the club at the point of the downswing after the release and shortly prior to impact with the ball, sometimes referred to as the impact zone. In FIG. 13A, a theoretical position of the golfer's hips and shoulders is depicted. In FIG. 13B, a dual hinge link atm model of the shoulder, arm, club, and golf swing trainer system presenting theoretical estimated vector forces imparted by the golf swing trainer is estimated according to one or more embodiments. In FIG. 13C, theoretically determined club head speed, drag from the GST, momentum and centrifugal force values imparted by the GST are indicated.

FIGS. 14A, 14B, and 14C schematically depict diagrams for an impact zone position of the downswing where the angle of the club shaft is about plus 30 degrees relative to a perpendicular direction from the golfer to the ball impact point. This corresponds to the position of the club after impact with the ball and after the ball would no longer be in contact with the face of the club head. In FIG. 14A, a theoretical position of the golfer's hips and shoulders is depicted. In FIG. 14B, a dual hinge link arm model of the shoulder, arm, club, and golf swing trainer system presenting theoretical estimated vector forces imparted by the golf swing trainer is estimated according to one or more embodiments. In FIG. 14C, theoretically determined club head speed, drag from the GST, momentum and centrifugal force values imparted by the GST are indicated.

This brings us back to the previous discussion of creating power with the hips, which the golf swing trainer accomplishes because it forces the user to lead with the hips. Once the backswing is accomplished on plane with the golf swing trainer in place on the club, the golf trainer essentially "shows" the golfer how to make a good swing because a good swing is required in order to swing the golf club rapidly when the golf swing trainer is in place. The wind resistance drag is felt by the golfer and the golfer learns that a fast swing will simply require generating the needed force by rapid hip movement and the sequence of torso, shoulder, arms, hands and club swing.

One swing of the golf club with the golf swing trainer in place on the club, shows the golfer that there is significant wind resistance applied at the club head and noticeable additional weight at the club head that provides momentum and centrifugal force effects on the club. These resistance forces, momentum forces and effects on the club are effectively enhanced versions of the forces that are also present to a less noticeable extent with a normal streamlined and light weight club. While a golfer's muscles can often control over the normally present forces of a light weight club, even with bad or inefficient and out of sequence movements, this is not the case when the forces are enhanced by the golf swing trainer. The enhanced forces in effect become controlling over the golfer's muscles requiring proper sequence and speed of each component of the swing. The unique configuration provides wind resistance force vectors and added weight momentum and centrifugal force vectors that simultaneously require essentially "all" the power a golfer can provide. The brain knows maximum swing force requires leading into the swing with rapid hip turning. As the swing is initiated the torso must twist to catch up to the hips. The shoulders turn following the twisting torso. The golfer naturally leads into the downswing by turning the hips. The sequence flows naturally from the proper initial movement based in part upon the anticipation from prior practice swings with the golf trainer in place. It is noted that the arms become desirably extended and after the club leaves the backswing starting point and the hands essentially move as a pendulum with the extended arm. The outward momentum or centrifugal force facilitated by the increased weight of the golf swing trainer acting at the head of the golf club. During the swing, the golfer feels the wind resistance applied at the head of the club and the golfer's brain energizes the hips, torso, shoulders and arms to keep the golf club moving with sufficient velocity to create release momentum. Feedback to the hands from the club therefore continues "showing" the golfer at each point in the swing the effectiveness of leading with rapid hip turning and accompanied torso twisting, shoulder turning, and extended arm swinging. A golfer naturally learns and feels that hip movement is required to provide a sufficient level of power and speed to overcome the wind resistance force vector acting at the head of the golf club. The sequential torso, shoulders, and arms continues based upon feedback from the club to the hands in real time. The club head naturally lags behind the hands because of the wind resistance and the feel of the release is naturally effectuated by the momentum of the added weight of the golf swing trainer. This effectively teaches the golfer's body "how" to create club head lag and how to generate power in the swing and at impact with ball.

Also, the golf swing trainer also has some useful features that help the golfer feel the proper time to release the club. Many golfers release the club too early which greatly reduces club head speed at impact.

Meaning, they allow (or force) the club to move outward before the optimal point. Various studies indicate that the optimal point to let the club release occurs about the time the golfer's arms are parallel with the ground. Professional golfers often hold it a little longer. Below is a chart of optimal club release.

The golf swing trainer encourages this because the resistance vector until the optimal release point is largely perpendicular to the club shaft. This makes it more difficult to release the club early. It is almost like an instructor holding the club in the proper position until the right time; something that obviously cannot be accomplished by an actual instructor.

The vector analysis, for example comparing FIGS. 11A, 11B, and 11C to FIGS. 12A, 12B, and 12C, shows that the added centrifugal forces of the golf swing trainer changed the "resolved" vector from a direction primarily perpendicular to the club to a vector that is in a more outward direction when the golfer's arms were just past the parallel point. This (subconsciously) teaches the golfer the appropriate time to release the club.

Follow-Through—Arm Extension

Golf teachers often praise golfers that have a full arm extension during their follow-through with the club pointing straight out creating a nice triangle with the arms. I believe this to ultimately be the result of a proper hip turn and swing sequence. Golfers that don't have a proper swing sequence, and are swinging the club with their upper body, usually end the swing with a "chicken wing" (below left) in their target side arm. The golf swing trainer encourages the proper swing sequence thus creating a fully extended follow-through (See FIG. 8).

Additionally, the added momentum of the golf swing trainer on the end of the club undoubtedly works to pull the arms outward after impact. This demonstrates to the golfer what fully extended arms should feel like.

Figures 15A, 15B, 15C, 16A, 16B, 16C:
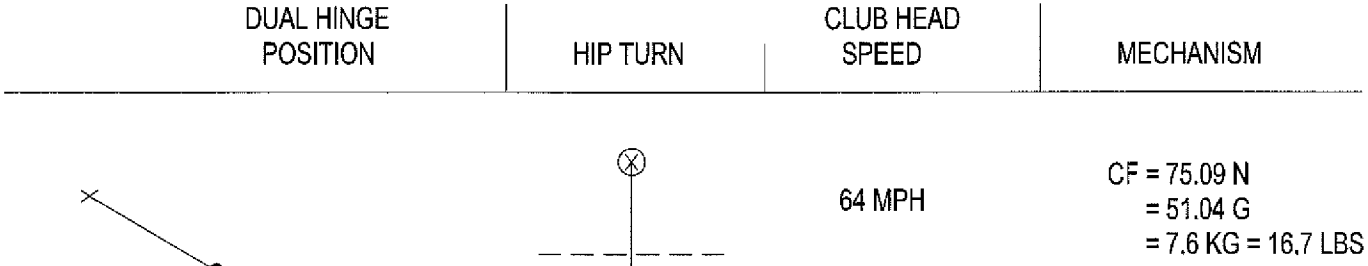
FIGS. 15A, 15B, and 15C are schematic depictions of diagrams for a post impact zone position of the downswing showing, in FIG. 15A, a theoretical position of the golfer's hips and shoulders, showing, in FIG. 15B, a link arm model of the shoulder, arm, club, and golf swing trainer system presenting theoretical, estimated vector forces imparted by the golf swing trainer according to one or more embodiments, and showing, in FIG. 15C, theoretically determined speed, drag, momentum and centrifugal force values.
FIGS. 16A, 16B, and 16C are schematic depictions of diagrams for a continued rotation position of the follow-through swing showing, in FIG. 16A, a theoretical position of the golfer's hips and shoulders, showing, in FIG. 16B, a link arm model of the shoulder, arm, club, and golf swing trainer system presenting theoretical, estimated vector forces imparted by the golf swing trainer according to one or more embodiments, and showing, in FIG. 16C, theoretically determined speed, drag, momentum and centrifugal force values.

FIGS. 15A, 15B, and 15C are schematic depictions of diagrams for a post impact zone position where the angle of the club shaft is about plus 60 degrees relative to a perpendicular direction from the golfer to the ball impact point. This corresponds to the position of the club after impact with the ball and as the follow-through is initiated. In FIG. 15A, a theoretical position of the golfer's hips and shoulders is depicted. In FIG. 15B, a dual hinge link arm model of the shoulder, arm, club, and golf swing trainer system presenting theoretical estimated vector forces imparted by the golf swing trainer is estimated according to one or more embodiments. In FIG. 15C, theoretically determined club head speed, drag from the GST, momentum and centrifugal force values imparted by the GST are indicated.

FIGS. 16A, 16B, and 16C are schematic depictions of diagrams for a continued rotation position of the follow-through swing where the angle of the club shaft is about plus 90 degrees relative to a perpendicular direction from the golfer to the ball impact point. This corresponds to the position of the club after impact with the ball and as the follow-through continues. In FIG. 16A, a theoretical position of the golfer's hips and shoulders is depicted. In FIG. 16B, a dual hinge link arm model of the shoulder, arm, club, and golf swing trainer system presenting theoretical estimated vector forces imparted by the golf swing trainer is estimated according to one or more embodiments. In FIG. 16C, theoretically determined club head speed, drag from the GST, momentum and centrifugal force values imparted by the GST are indicated.

FIGS. 17A, 17B, and 17C are schematic depictions of diagrams for a rotation position of the follow-through swing where the angle of the club shaft is about plus 130 degrees relative to a perpendicular direction from the golfer to the ball impact point. This corresponds to the position of the club in a continued rotation portion of the follow-through. In FIG. 17A, a theoretical position of the golfer's hips and shoulders is depicted. In FIG. 17B, a dual hinge link arm model of the shoulder, arm, club, and golf swing trainer system presenting theoretical estimated vector forces imparted by the golf swing trainer is estimated according to one or more embodiments. In FIG. 17C, theoretically determined club head speed, drag from the GST, momentum and centrifugal force values imparted by the GST are indicated.

FIGS. 18A, 18B, and 18C are schematic depictions of diagrams for an upward rotation position of the follow-through swing where the angle of the club shaft is about plus 160 degrees relative to a perpendicular direction from the golfer to the ball impact point. This corresponds to the position of the club during a rearward portion of the follow-through. In FIG. 18A, a theoretical position of the golfer's hips and shoulders is depicted. In FIG. 18B, a dual hinge link arm model of the shoulder, arm, club, and golf swing trainer system presenting theoretical estimated vector forces imparted by the golf swing trainer is estimated according to one or more embodiments. In FIG. 18C, theoretically determined club head speed, drag from the GST, momentum and centrifugal force values imparted by the GST are indicated.

Figures 19A, 19B, 19C, 20A, 20B, 20C:
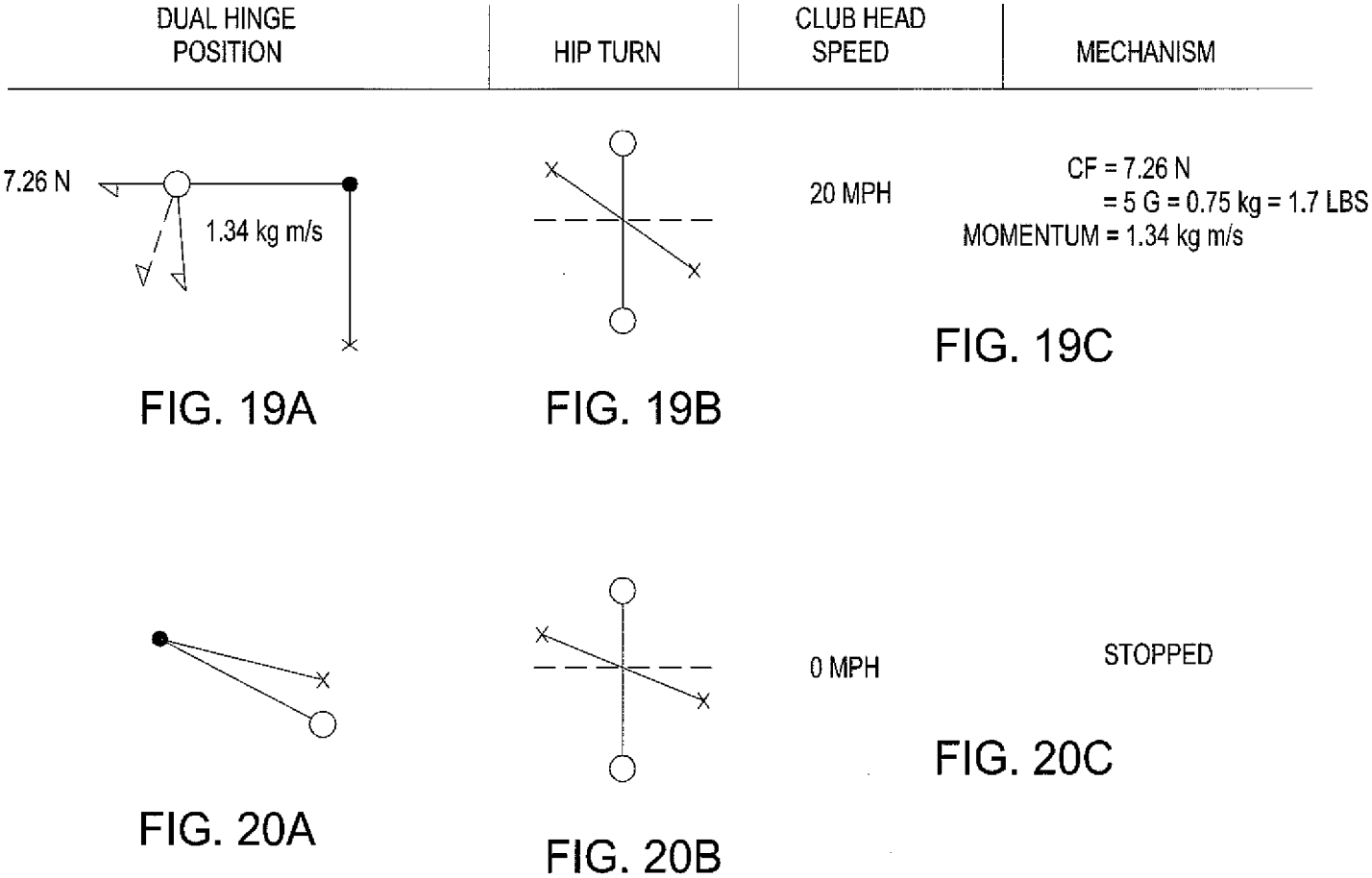
FIGS. 19A, 19B, and 19C are schematic depictions of diagrams for an rearward rotation position of the follow-through swing showing, in FIG. 19A, a theoretical position of the golfer's hips and shoulders, showing, in FIG. 19B, a link arm model of the shoulder, arm, club, and golf swing trainer system presenting theoretical, estimated vector forces imparted by the golf swing trainer according to one or more embodiments, and showing, in FIG. 19C, theoretically determined speed, drag, momentum and centrifugal force values.
FIGS. 20A, 20B, and 20C are schematic depictions of diagrams for a completion rotation position of the follow-through swing showing, in FIG. 20A, a theoretical position of the golfer's hips and shoulders, showing, in FIG. 20B, a link arm model of the shoulder, arm, club, and golf swing trainer system presenting theoretical, estimated vector forces imparted by the golf swing trainer according to one or more embodiments, and showing, in FIG. 20C, theoretically determined speed, drag, momentum and centrifugal force values.

FIGS. 19A, 19B, and 19C are schematic depictions of diagrams for a rearward rotation position of the follow-through swing where the angle of the club shaft is about plus 270 degrees relative to a perpendicular direction from the golfer to the ball impact point. This corresponds to the position of the club during a rearward rotation part of the follow-through. In FIG. 19A, a theoretical position of the golfer's hips and shoulders is depicted. In FIG. 19B, a dual hinge link arm model of the shoulder, arm, club, and golf swing trainer system presenting theoretical estimated vector forces imparted by the golf swing trainer is estimated according to one or more embodiments. In FIG. 19C, theoretically determined club head speed, drag from the GST, momentum and centrifugal force values imparted by the GST are indicated.

FIGS. 20A, 20B, and 20C are schematic depictions of diagrams for a completion rotation position of the follow-through swing where the angle of the club shaft is about plus 400 degrees relative to a perpendicular direction from the golfer to the ball impact point. This corresponds to the position of the club at a full stop of a completed follow-through. In FIG. 15A, a theoretical position of the golfer's hips and shoulders is depicted. In FIG. 15B, a dual hinge link arm model of the shoulder, arm, club, and golf swing trainer system presenting theoretical estimated vector forces imparted by the golf swing trainer is estimated according to one or more embodiments. In FIG. 15C, theoretically determined club head speed, drag from the GST, momentum and centrifugal force values imparted by the GST are indicated.

Follow-Through—Ending Position

Golf instructors encourage their students to end the swing with a majority of their weight on the target side foot, standing tall, with the hands high and the club in a position approximating where the strap on the back of a baseball cap would be. The momentum of the club and the added momentum of the golf swing trainer work in conjunction with the fully extended arm position to move the club smoothly into the desired finishing position. As the club slows down due to the golfer's natural flexibility limits, there is a slight tug on the end of the club due to the golf swing trainer's momentum that increases the travel of the club head slightly further than normal. This aids in encouraging the golfer to reach a solid finishing position, and works to increase flexibility over time.

While the invention has been described with respect to a limited number of embodiments, and the discussion has focused on one or more particular embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A golf swing trainer (GST) device, for use on a golf club of the type having a shaft with a hand grip region, a middle region, a neck, and a club head connected at the neck of the shaft, the GST device comprising:

a cape comprising a flexible fabric material formed with an exterior edge defining a substantially radially symmetrical shape;

the cape comprising a first opening generally centrally located in the radially symmetrical flexible fabric material and a second opening located in the symmetrical flexible fabric material extending from the exterior edge of the fabric material inward toward the first opening, the first and second openings sized for receiving the golf club therethrough, and defining a generally centrally located connection region of the flexible fabric material between the first and second openings; and a fastener for removably securing the cape to the golf club with the club shaft extended through the first and second openings with the connection region overlaying the neck of the club adjacent to the club head.

2. The golf swing trainer (GST) device of claim 1, wherein the symmetrical shape of the cape is a circular shape.

3. The golf swing trainer (GST) device of claim 1, wherein the symmetrical shape of the cape is a polygon shape.

4. The golf swing trainer (GST) device of claim 1, wherein the symmetrical shape of the cape is an oval.

5. The golf swing trainer (GST) device of claim 1, wherein the symmetrical shape of the cape is a polygon with rounded corners.

6. The golf swing trainer (GST) device of claim 1, wherein the symmetrical shape of the cape comprises a radially symmetrical shape having a maximum radius in a range of about 20 cm to about 45 cm (about 8 inches to about 18 inches).

7. The golf swing trainer (GST) device of claim 1, wherein the fabric material of the cape comprises a flexible vinyl fabric material having a thickness in the range of about 4 mils to about 20 mils (about 0.10 mm to about 0.50 mm) and a weight in a range of about 5 ounces per square yard to about 25 ounces per square yard (about 6 oz. per square meter to about 30 oz. per square meter).

8. The golf swing trainer (GST) device of claim 1, wherein the flexible vinyl fabric material of the cape is a thin flexible vinyl fabric having a thickness in the range of about 6 mils to about 12 mils (0.15 mm to about 0.30 mm).

9. The golf swing trainer (GST) device of claim 1, wherein the flexible vinyl fabric material of the cape is a water resistant fabric backed vinyl fabric material.

10. The golf swing trainer (GST) device of claim 1, wherein the first opening sized for receiving the club head of the golf club therethrough comprises a centrally located hole formed in the fabric material having a rounded perimeter.

11. The golf swing trainer (GST) device of claim 1, wherein the first opening sized for receiving the club bead of the golf club therethrough comprises a centrally located circular hole formed in the fabric material.

12. A golf swing trainer (GST) device, for use on a golf club of the type having a shaft with a hand grip region, a middle region, a neck, and a club head connected at the neck of the shaft, the GST device comprising:

a cape comprising a flexible fabric material formed with an exterior edge a substantially symmetrical shape wherein the fabric material comprises a flexible vinyl fabric, the symmetrical shape of the cape comprises a radially symmetrical shape;

the cape comprising a first opening and a second generally centrally located in the symmetrical flexible fabric material, the first and second openings sized for receiving the golf club therethrough, and defining a connection region of the flexible fabric material between the first and second openings the first opening comprises a rounded opening generally in a central location in the cape, wherein the second opening comprises a slit cut in the symmetrical flexible vinyl fabric material extending from and exterior edge of the symmetrical shape inward toward the centrally located rounded first opening and the second opening terminating a relatively short distance from the first opening and thereby forming connection region defined by a portion of vinyl material of the cape generally centrally located between the first generally centrally located rounded opening and the second opening formed by the slit; and a fastener for removably securing the cape to the golf club with the club shaft extended through the first and second openings with the connection region overlaying the neck of the club adjacent to the club head, wherein the fastener comprises a strap securable around the connection region to fasten the cape to the neck of the golf club and so that the cape is movable relative to the golf club and may be flexibly draped from the club shaft adjacent to the club head and the fastener strap wrapped around the vinyl material of the connection region bunched around the neck of the shaft thereby pivotably holding the cape onto the shaft of the club at the neck of the club.

13. The golf swing trainer (GST) device of claim 12, wherein the slit cut in the symmetrical flexible thin vinyl material extending from the exterior edge of the symmetrical shape inward toward the first centrally located opening comprises a straight slit cut in a substantially radial direction.

14. The golf swing trainer (GST) device of claim 12, wherein the slit cut in the symmetrical flexible thin vinyl material extending from the exterior edge of the symmetrical shape inward toward the first opening comprises a slit cut along a curved line from the perimeter to a location proximate to the first opening.

15. A golf swing trainer (GST) device, for use on a golf club of the type having a shaft with a hand grip region, a middle region, a neck, and a club head connected at the neck of the shaft, the GST device comprising:

a cape comprising a flexible vinyl fabric material formed with an exterior edge defining a substantially radially symmetrical shape, and the cape comprising at least one opening through the flexible vinyl material, centrally located relative to all of the exterior edge of the radially symmetrically shaped flexible vinyl material, and through which the neck of the golf club may be received and a connection region defined by a portion of vinyl material of the cape generally centrally located on the symmetrical flexible vinyl fabric material.

16. The golf swing trainer (GST) device of claim 15, comprising a fastener strap sized for removably securing the cape to the connection region of the cape to the golf club at the neck adjacent to the club head.

17. The golf swing trainer (GST) device of claim 16, wherein the fastener strap for securing the cape to the neck portion of the golf club comprises a fastener having a mechanism secured thereto for removably securing the strap around the connection region of the cape to removably secure the cape on the golf club.

18. The golf swing trainer (GST) device of claim 17, wherein the fastener strap for securing the cape to the neck portion of the golf club comprises a strap with hook and loop connection mechanisms secured thereto.

19. The golf swing trainer (GST) device of claim 15, wherein the connection region defined by a portion of the vinyl fabric material of the cape comprises a portion of the vinyl fabric material between a first opening and a second opening sized for receiving the shaft of the golf club therethrough.

20. The golf swing trainer (GST) device of claim 19, wherein the first opening is sized for receiving the club head of the golf club therethrough, the second opening is sized for receiving the shaft of the golf club there through; and further comprising a fastener for securing the connection region of the cape around the neck of the club with the club head extended through the first opening.

21. A golf swing trainer (GST) device, for use on a golf club of the type having a shaft with a hand grip region, a middle region, a neck, and a club head connected at the neck of the shaft, the GST device comprising:

a cape comprising a flexible vinyl fabric material formed with an exterior edge defining a substantially radially symmetrical shape;

the cape comprising an opening generally centrally located in the radially symmetrical flexible vinyl fabric material and the opening sized for receiving the club head of the golf club therethrough;

the cape comprising a connection region adjacent to the centrally located opening, the connection region defined by a portion of vinyl material of the cape between a slit cut in the symmetrical flexible thin vinyl material extending from the portion of vinyl material forming the connection region and radially outward through the exterior edge of the radially symmetrical shape; and a fastener having a mechanism formed thereon for removably securing the cape to the golf club, with the club head extended through the opening, the connection region overlaying the neck with the cape draped adjacent to the shaft of the club, the middle of the shaft through the slit and the fastener strap wrapped around the vinyl material of the connection region bunched around the neck of the shaft thereby holding the cape onto the shaft of the club at the neck and immediately adjacent to the club head.

22. A method for training a golfer to perform a good golf swing using a golf club, the method comprising:

providing a golf swing trainer (GST) device, for use on the golf club of the type having a shaft with a hand grip region, a middle region, a neck, and a club head connected at the neck of the shaft, the GST device comprising:

a cape comprising a flexible vinyl fabric material formed with an exterior edge defining a substantially radially symmetrical shape;

the cape comprising a connection region defined by a portion of vinyl material of the cape generally centrally located on the radially symmetrical flexible vinyl fabric material;

removably fastening the flexible cape to the neck of the golf club shaft immediately adjacent to the head of the golf club;

grasping the golf club at a hand grip region of the golf club with the shaft at a slight angle in front of the golfer and the club head at a ball address position with the golf club face directly adjacent to the point of intended club-to-ball impact and with the vinyl cape fastened to the neck of the club shaft;

holding the golf club with the club head in a club-ball impact position for starting a backswing with the exterior edge of the cape supported on the ground adjacent to the club head;

providing the golfer with the objective of keeping the golf swing trainer cape in a position draped evenly over the club head during a backswing, wherein the backswing comprises a one-piece, low, slow, on-plane takeaway portion of the backswing so that the material of the cape is proportionally positioned over the club head to maintain a substantially unchanging angle of attack and the same relative wind resistance against the cape on either side of the golf club shaft;

drawing the club rearward to move the club in the takeaway portion of the backswing on-plane so that the cape material drapes trailing the club and continuing the backswing with the golfer's body, turning the hips, rotating the torso, rotating the shoulders and carrying the golfer's arms, hands, golf club with cape in an on-plane backswing away from the club-ball impact position;

continuing the backswing upwardly and behind the golfer's head with the forward arm remaining extended outward, straight or only slightly bent at the elbow, the rear arm bent naturally at the elbow and the wrists bent naturally as the golf club is carried back making an acute angle of 45 degrees to 30 degrees relative to the forward arm until the golf club moves to a position behind the golfer's head, above the shoulders and with the golf club shaft substantially parallel to the ground;

reversing the swing direction to a downswing initiated by a sequential movement of moving the target side knee toward the target, turning the hips in a direction toward the target followed by twisting the torso, turning the shoulders, swinging the arms extended as they are moved by the torque of the twisting torso and turning shoulders so that the arms and hands swing the golf club with the wrist of the hands bent so that the head of the club follows and lags behind the movement of the hands and until the arms and hands have reached a position generally parallel to the ground;

releasing the golf club swing by allowing the wrist to pivot and bend forward in the direction of the swing so that the club head is pulled outward due to centrifugal forces, thereby rotating about the wrist in the direction forward so that the club head effectively catches up with the hands at the point of club-to-ball impact;

following through with the swing by continued turning the hips in a direction perpendicular to the target followed by twisting the torso, turning the shoulders, swinging the arms extended as they are moved by the momentum of the golf club and additional weight of the cape so that the arms are extended straight outward forming a "V" shape with each from the shoulders and the golf club swings the hands with the wrist pivoting so that the head of the club swings to a position behind the golfer's head to a position generally parallel to the ground.

23. A method for training a person to make a golf swing using a golf club, the system comprising:

fastening a flexible cape to the neck of the golf club, the flexible cape removably fastened to the golf club shaft immediately adjacent to the head of the golf club and having an exterior edge defining a substantially radially symmetrical shape, grasping the golf club at a hand grip region of the golf club with the shaft at a slight angle in front of the golfer and the club head at a ball address position with the golf club face directly adjacent to the point of intended club-to-ball impact and with the vinyl cape fastened to the neck of the club shaft;

holding the golf club with the club head in a club-ball impact position for starting a backswing with exterior edge of the cape supported on the ground adjacent to the club head, providing the golfer with the objective of keeping the golf swing trainer cape in a position draped evenly over the club head during a backswing, wherein the backswing comprises a one-piece, low, slow, on-plane takeaway portion of the backswing so that the material of the cape is proportionally positioned over the club head to maintain a substantially unchanging angle of attack and the same relative wind resistance against the cape on either side of the golf club shaft, drawing the club rearward to move the club in the takeaway portion of the backswing on-plane so that the cape material drapes trailing the club and continuing the backswing with the golfer's body, turning the hips, rotating the torso, rotating the shoulders and carrying the golfer's arms, hands, golf club with cape in an on-plane backswing away from the club-ball impact position continuing the backswing upwardly and behind the golfer's head with the forward arm remaining extended outward, straight or only slightly bent at the elbow, the rear arm bent naturally at the elbow and the wrists bent naturally as the golf club is carried back making an acute angle of 45 degrees to 30 degrees relative to the forward arm until the golf club moves to a position behind the golfer's head, above the shoulders and with the golf club shaft substantially parallel to the ground;

reversing the swing direction to a downswing initiated by a sequential movement of moving the target side knee toward the target, turning the hips in a direction toward the target followed by twisting the torso, turning the shoulders, swinging the arms extended as they are moved by the torque of the twisting torso and turning shoulders so that the arms and hands swing the golf club with the wrist of the hands bent so that the head of the club follows and lags behind the movement of the hands and until the arms and hands have reached a position generally parallel to the ground;

releasing the golf club swing by allowing the wrist to pivot and bend forward in the direction of the swing so that the club head is pulled outward due to centrifugal forces, thereby rotating about the wrist in the direction forward so that the club head effectively catches up with the hands at the point of club-to-ball impact; and following through with the swing by continued turning of the hips in a direction perpendicular to the target followed by twisting the torso, turning the shoulders, swinging the arms extended as they are moved by the momentum of the golf club and additional weight of the cape so that the arms are extended straight outward forming a "V" shape with each from the shoulders and the golf club swings the hands with the wrist pivoting so that the head of the club swings to a position behind the golfers head to a position generally parallel to the ground;

repeating several repetitions of the foregoing swing with the golf club trainer attached to the golf club while attempting to maintain a smooth take away backswing, a powerful rapid forward swing, and a completed follow-through;

removing the golf swing trainer from the golf club after several repetitions and swinging the golf club through the same take away swing, forward swing and follow through motions for a couple of repetitions; and placing a golf ball at the club-to-ball impact area and with the golf club trainer removed swinging the golf club including a take away portion of the swing, a forward swing, hitting the golf ball and following through.

* * * * *